US006976540B2

(12) United States Patent
Berry

(10) Patent No.: US 6,976,540 B2
(45) Date of Patent: Dec. 20, 2005

(54) METHOD AND APPARATUS FOR OFFLINE STANDBUILDING

(75) Inventor: Joe Berry, Cypress, TX (US)

(73) Assignee: Varco I/P, Inc., Orange, CA (US)

( * ) Notice: Subject to any disclaimer, the term of this patent is extended or adjusted under 35 U.S.C. 154(b) by 0 days.

(21) Appl. No.: 10/734,923

(22) Filed: Dec. 12, 2003

(65) Prior Publication Data

US 2005/0126827 A1 Jun. 16, 2005

(51) Int. Cl.[7] ..... E21B 19/18; E21B 19/20; B66C 1/42

(52) U.S. Cl. ..... 166/380; 166/77.53; 166/85.5; 175/52; 175/85; 414/22.54; 414/22.71; 24/90; 24/92; 24/104

(58) Field of Search ..... 166/378, 380, 166/381, 382, 98, 75.11, 77.1, 78.1, 77.51, 166/77.52, 77.53, 85.1, 85.5; 175/52, 57, 175/85; 414/22.51, 22.52, 22.54, 22.62, 22.63, 414/22.66, 22.71, 22.68; 294/90, 92, 104

(56) References Cited

U.S. PATENT DOCUMENTS

| | | | | |
|---|---|---|---|---|
| 3,976,207 | A | 8/1976 | Schultz | |
| 4,126,348 | A * | 11/1978 | Palmer | 294/88 |
| 4,139,891 | A | 2/1979 | Sheldon et al. | |
| 4,274,778 | A | 6/1981 | Putnam et al. | |
| 4,610,315 | A | 9/1986 | Koga et al. | |
| 4,709,766 | A | 12/1987 | Boyadjieff | |
| 4,765,401 | A | 8/1988 | Boyadjieff | |
| 4,834,604 | A | 5/1989 | Brittain et al. | |
| 4,850,439 | A | 7/1989 | Lund | |
| 4,901,805 | A * | 2/1990 | Ali-Zade et al. | 175/85 |
| 5,107,940 | A | 4/1992 | Berry | |
| 6,513,605 | B1 | 2/2003 | Lödden | |
| 6,527,493 | B1 | 3/2003 | Kamphorst et al. | |
| 6,550,128 | B1 | 4/2003 | Lorenz | |
| 6,705,414 | B2 * | 3/2004 | Simpson et al. | 175/52 |
| 2002/0000333 | A1 * | 1/2002 | Cicognani | 175/85 |
| 2003/0159854 | A1 | 8/2003 | Simpson et al. | |
| 2004/0045703 | A1 * | 3/2004 | Hooper et al. | 166/77.51 |

OTHER PUBLICATIONS

International Search Report for International Application no. PCT/US03/39569; 5pp.

* cited by examiner

*Primary Examiner*—Jennifer H Gay
(74) *Attorney, Agent, or Firm*—Christie, Parker & Hale, LLP

(57) ABSTRACT

A method and apparatus for moving pipe on a rig floor between a number of different stations are provided. Generally the apparatus includes pipehandling equipment arranged to interact with an off-floor rack, a preparation opening, a borehole, and a storage area, such that tubulars can be loaded onto the drill floor, prepared at the preparation opening, loaded onto or off of the storage rack, and connected to a drill string while drilling is simultaneously conducted at borehole. In one embodiment, the system includes at least two pipehandling devices for communicating pipe between a storage area off the drill floor, a storage area on the drill floor, at least one preparation opening, and a drill opening.

37 Claims, 21 Drawing Sheets

METHOD AND APPARATUS FOR OFFLINE STANDBUILDING

CROSS REFERENCE TO RELATED APPLICATIONS

This patent application claims the benefit of PCT International Application No. PCT/US2003/39569, filed Dec. 12, 2003, the disclosures of which is incorporated herein by reference, as if fully stated here, for all purposes.

FIELD OF THE INVENTION

The present invention relates to an integrated method and apparatus for loading, interconnecting and disconnecting, and storing tubulars on an oil drilling platform without interrupting the drilling process.

BACKGROUND OF THE INVENTION

During a drilling operation on a conventional oil drilling platform, when the drill bit has penetrated such a distance into a borehole that only a small part of the drill string extends upwards from the upper surface of the drill floor, the drilling operation must be stopped, and a new tubular drill string section moved from a storage site or rack positioned outside the drill floor and connected to the upper end of the drill string. Once the new section is connected the drilling operation may be continued. Normally, the length of the drill string sections is 30 feet or about 10 m. This means that each time the drill bit has penetrated further 10 m into the underground the drilling operation has to be stopped and a further drill string section has to be added as described above.

This process creates significant idle time in which no actual drilling takes place. In view of the fact that the investment made in a drilling rig is very high (as an example the daily rent of an offshore rig may be on the order of U.S. $ 50,000) even a relatively small reduction of the necessary idle time is of great economical importance.

One solution commonly used to reduce the idle time on drilling rigs is to assemble two drill string sections, or singles, each having a length of about 10 m into a 20 m stand, or double, placing the singles in a mousehole adjacent to the drilling opening and connecting the singles by using air tuggers and spinning wrenches while the drilling operation proceeds. One exemplary system and apparatus for such offline standbuilding is described in U.S. Pat. No. 4,850,439, the disclosure of which is incorporated herein by reference. However, although these conventional offline standbuilding systems do create significant efficiencies in the drilling process, they generally utilize many complex pieces of equipment, such as, hoists and multi-purpose pipehandling machines that result in a system which is complicated, costly, and requires significant ongoing maintenance.

Accordingly, a need exists for a simpler, less costly system for providing offline stand building and pipehandling functionality to standard oil platforms.

SUMMARY OF THE INVENTION

The present invention provides a method and apparatus for moving pipe on a rig floor between a number of different stations including an off-floor rack, a preparation opening, a borehole, and a storage area, such that tubulars can be loaded onto the drill floor, prepared at the preparation opening, loaded onto or off of the storage rack, and connected to the drill string while drilling is simultaneously conducted at the borehole.

In one embodiment, the method and apparatus comprises at least two pipehandling devices for communicating pipe between a storage area off the drill floor, a storage area on the drill floor, at least one preparation opening, and a drill opening.

In one embodiment of the invention one of the at least two pipehandling devices is a tubular load and preparation pipehandling device designed to move joints of drill pipe or other tubulars from the V-door of the rig and deliver them into a pair of preparation openings for building stands while drilling activities continue at well center. In one such embodiment, the system consists of a stand building truss device comprising a vertical truss mounted inside the derrick in a position where it can access the V-door pick up point and preparation openings using a powered slew about a vertical axis.

In another embodiment, the radius of the tubular load and preparation pipehandling device intersects the operating reach of a tubular torquing device, such as a standard iron roughneck for making up connections between tubulars. In such an embodiment it is preferred for the operating reach of the iron roughneck to also intersect the well center and the preparation openings for use in making connections while tripping.

In another embodiment of the invention the radius of the tubular load and preparation pipehandling device is also designed to intersect through a V-door, the edge of the drilling platform such that the pipehandling device may hoist tubulars from outside off the drilling platform, such as from an external storage area via a tubular ramp.

In still another embodiment of the invention at least one of the at least two pipehandling devices is a storage pipehandling device comprising a robotic arm mounted generally in a mast or derrick type drilling structure to provide for moving drill pipe and drill collars between the well center or stand building location to the setback position and back again.

In yet another embodiment the invention comprises a method of loading, constructing and drilling comprising a series of steps including moving tubulars with the load and preparation pipehandling device from off the drill floor to on the drill floor, then constructing stands of pipe out of the tubulars at the preparation opening, and then withdrawing the prepared stands from the preparation opening to the storage area by means of the storage pipehandling device.

In one such embodiment, during operation the load and preparation pipehandling device picks up a tubular body at the V-door pick up point and moves it to a first preparation hole position. The load and preparation pipehandling device is then moved back to the V-door pick up position and a second tubular body is hoisted and rotated to the preparation opening and placed in a second preparation opening. The load and preparation pipehandling device is disconnected from the tubular body and the load and preparation pipehandling device rotated back to the V-door pick up position and a third joint is hoisted and slewed into position over the first preparation opening and joined with the first tubular using an iron roughneck or other conventional torque wrench device into a double. The double is then hoisted clear of the first preparation opening and the load and preparation pipehandling device is slewed over the second preparation opening and the double is joined with the third tubular body to make a treble or stand. The made-up length is then hoisted and the load and preparation pipehandling device is slewed towards the storage pipehandling device. The storage pipehandling device is used to accept the length from the load and preparation pipehandling device and the storage pipehandling device retracts and moves the stand into the desired position in the storage area.

In still yet another embodiment of the invention, the joints or tubular body sections used in the method and apparatus according to the invention may comprise drill tube singles, well casing singles, drill collars, stabilizers, centralizers, scratchers, drill bits, and other drill string or drill casing components as well as production tubing sections. By using the method according to the invention, such tubular body sections may be assembled into tubular lengths, such as drill string and well casing stands (usually doubles or triples), bottomhole assemblies or bottomhole assembly parts, logging assemblies, etc.

In still yet another embodiment, the method and apparatus of the current invention may also be used for disassembling tubular lengths, and the resulting tubular body sections or singles may then be transported to the storage area on the drill floor or to an alternative storage site outside the drill floor.

It should be understood that the drilling rig according to the invention may be a land rig as well as an offshore rig.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

The present invention provides an apparatus for moving pipe on a rig floor between a number of different stations including an off-floor rack, a preparation opening, a borehole, and a storage area, such that tubulars can be loaded onto the drill floor, prepared at the preparation opening loaded onto or off of the storage rack, and connected to a drill string while drilling is simultaneously conducted at the borehole.

Figure 1:
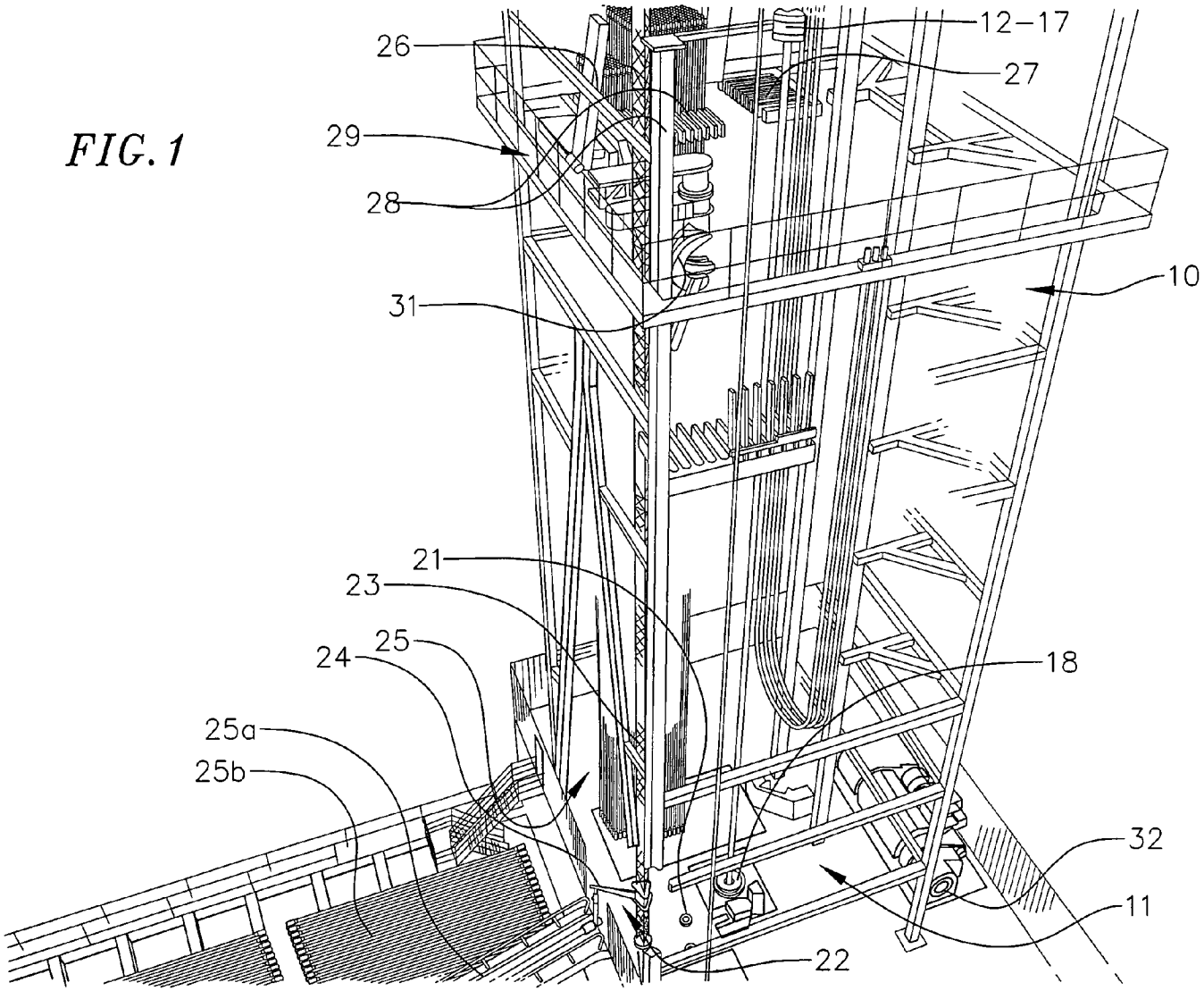
FIG. 1 is a side view of the derrick of one exemplary embodiment of a drilling rig according to the invention.

An exemplary drilling rig integrating the current invention is shown schematically in FIG. 1 of the drawings and generally comprises a derrick 10 extending upwards from a drill floor or platform area 11. A drilling hoist 12 comprising a traveling block 13 and a swivel and hook assembly 14 is mounted at the upper part of the derrick 10. A top drive unit 15, which is mounted on a carriage 16 so as to be displaceable along a vertically extending track 17, is suspended by the hoist 12 in a manner known per se. The drilling hoist 12 and the top drive unit 15 suspended thereby are substantially aligned with a drilling opening 18 defined in the drill floor, and the top drive unit 15 may be brought into rotary driving engagement with the upper end of a drill string 19 extending through the drilling opening 18.

At least one assembling or preparation opening 21, which is defined in the drill floor 11 is located adjacent to the drilling opening 18. A tube handling and transporting mechanism for loading drill pipe and preparing drill stands 22 ("load and preparation pipehandling device") comprising a vertically extending frame 23 and vertically aligned gripping device 24 mounted thereon is also provided adjacent to the preparation opening 21 and a vertical or V-door 25 provided in the side of the derrick 10 for access to areas off the drill floor 11, such as an external catwalk 25*a* and a tubular access ramp 25*b*.

The drill floor 11 may further comprise storage areas 26 and 27 arranged in setback areas within the confines of the derrick for storing drill string or well casing stands or bottomhole assembly parts in a vertical position, for example by means of conventional fingerboards 28. In such an embodiment, a second tube handling and transporting mechanism 29 ("storage pipehandling device") for loading and unloading stands of tubulars from the storage areas 26 and 27 comprising a rotatable and extendable gripping device 31 mounted generally in the setback area within the derrick structure to provide for moving tubulars between the well center or stand building location to the setback position or back again. In one preferred embodiment, as shown in FIGS. 1 to 3, the second pipehandling device 29 is mounted in an upper portion of the derrick between the two storage areas 26 and 27.

The drill floor further carries drawworks 32 associated with the drilling hoist 12. A drillers' cabin and a cabin for the operator of the preparation hoist and other devices may also be placed on the drill floor. It should be understood that although one configuration of these devices is shown in FIG. 1 that any functional arrangement of these elements may be utilized in the offline standbuilding system of the current invention.

Figure 2:
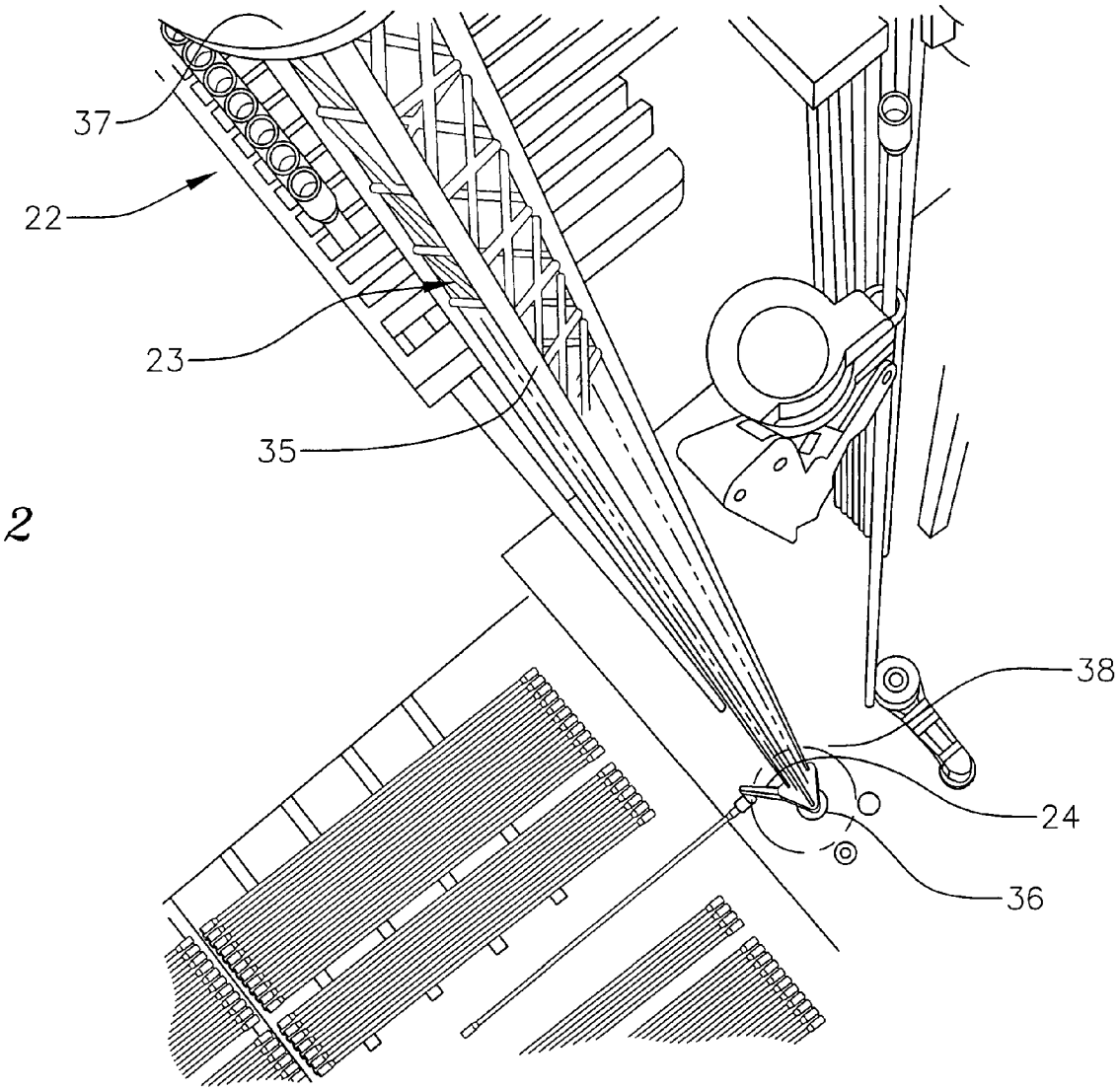
FIG. 2 is a diagrammatic view of an exemplary load and preparation pipehandling device according to the invention.
Figure 3:
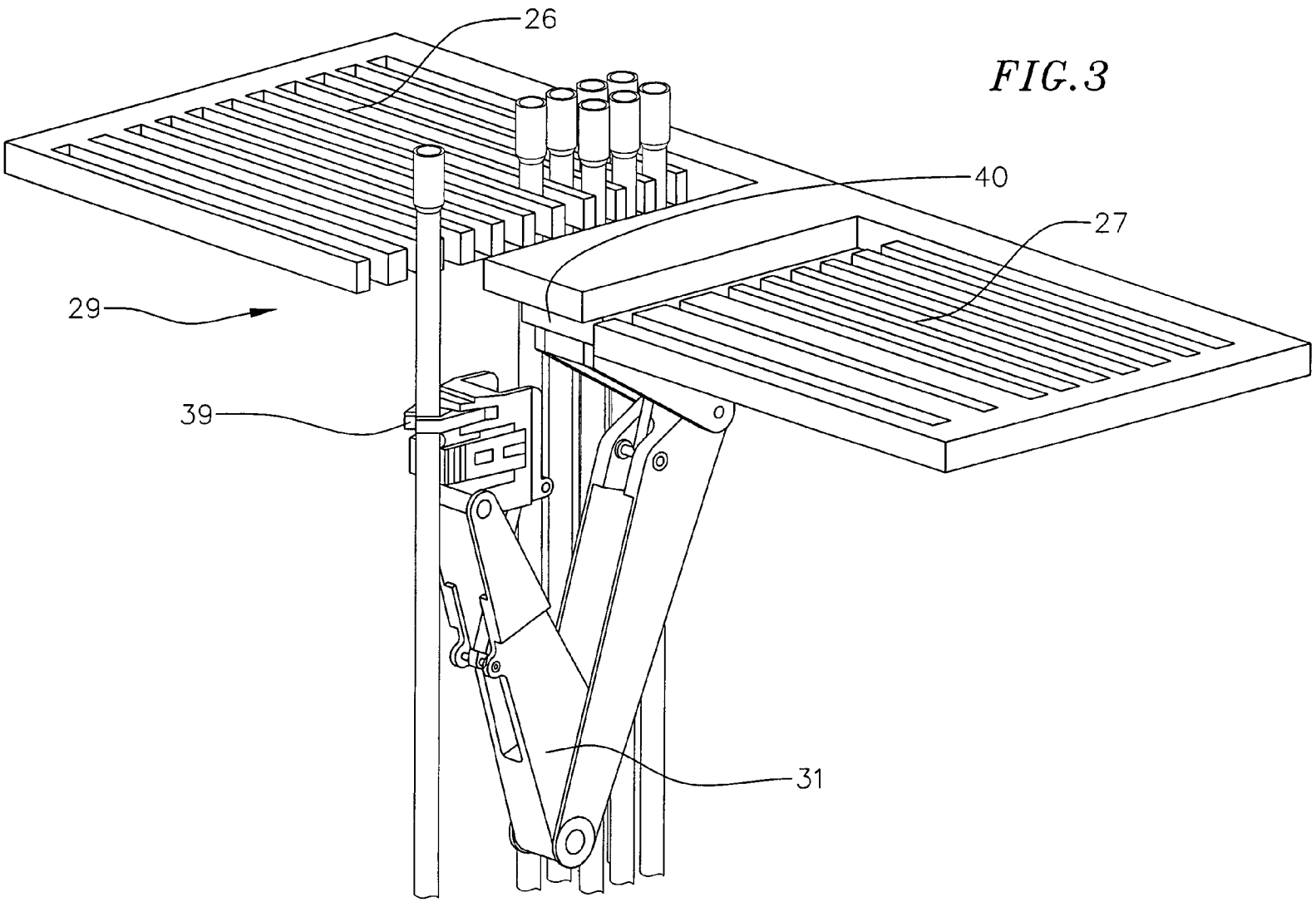
FIG. 3 is a diagrammatic view of an exemplary storage pipehandling device according to the invention.

As shown in detail FIG. 2, in one embodiment the frame 23 of the load and preparation tube handling and transporting mechanism (pipehandling device) 22 comprises a vertical shaft 35, which is mounted in lower 36 and upper 37 rotary platforms, so that the shaft may be pivoted about its longitudinal axis. In such an embodiment, the gripping device 24 may either comprise a gripper attached at the end of a hoisting line arranged at the end of an arm of fixed radius, or may alternatively be attached at the end of an arm which may be extended a predefined distance out from the vertical shaft 35. In either embodiment, the gripping device 24 may swing around the axis of the tube handling and transporting mechanism as the shaft 35 is rotated such that the gripping device 24 may be moved within a circle 38 of defined outer radius which is indicated by a dot-and-dash line in FIG. 2.

Figure 4:
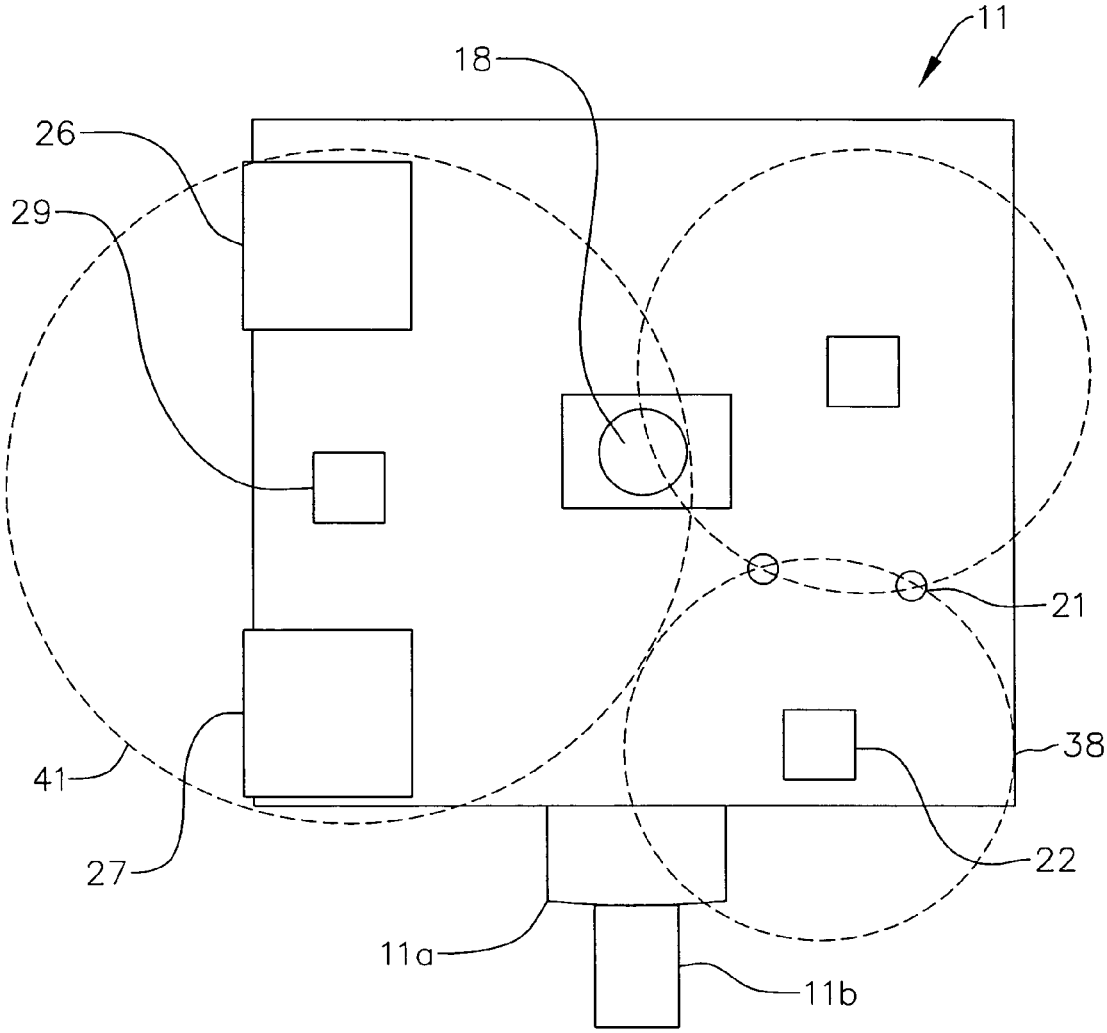
FIG. 4 is a diagrammatic top plan view showing the drill floor of the exemplary embodiment of the drilling rig shown in FIG. 1.
Figure 5:
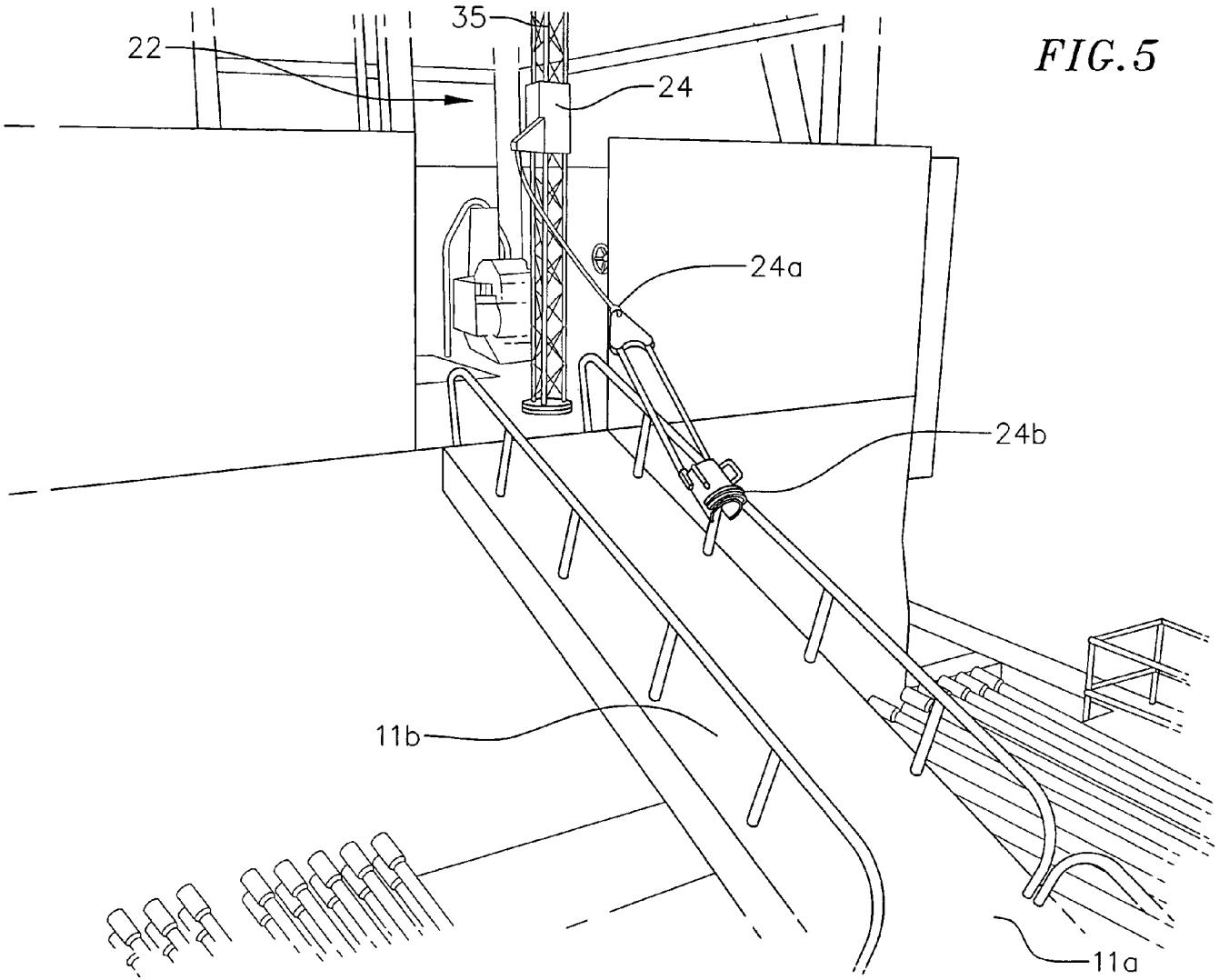
FIG. 5 is a diagrammatic view of an exemplary load and preparation pipehandling device having off-platform pipehandling capabilities according to the invention.
Figure 6:
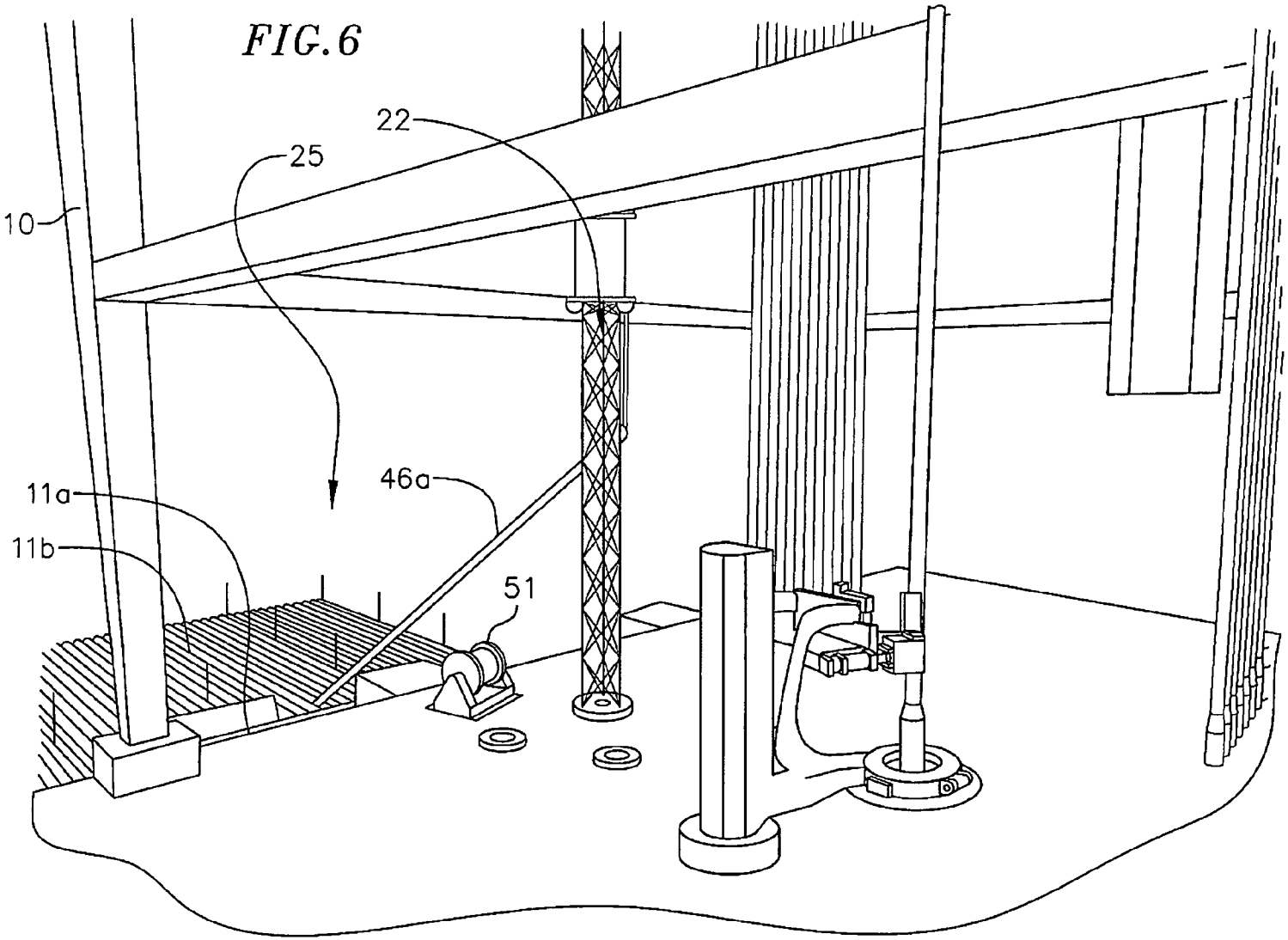
FIGS. 6–21 are diagrammatic side views corresponding to that shown in FIG. 1 and illustrating various steps of one exemplary embodiment of the drilling method according to the invention.
Figure 7:
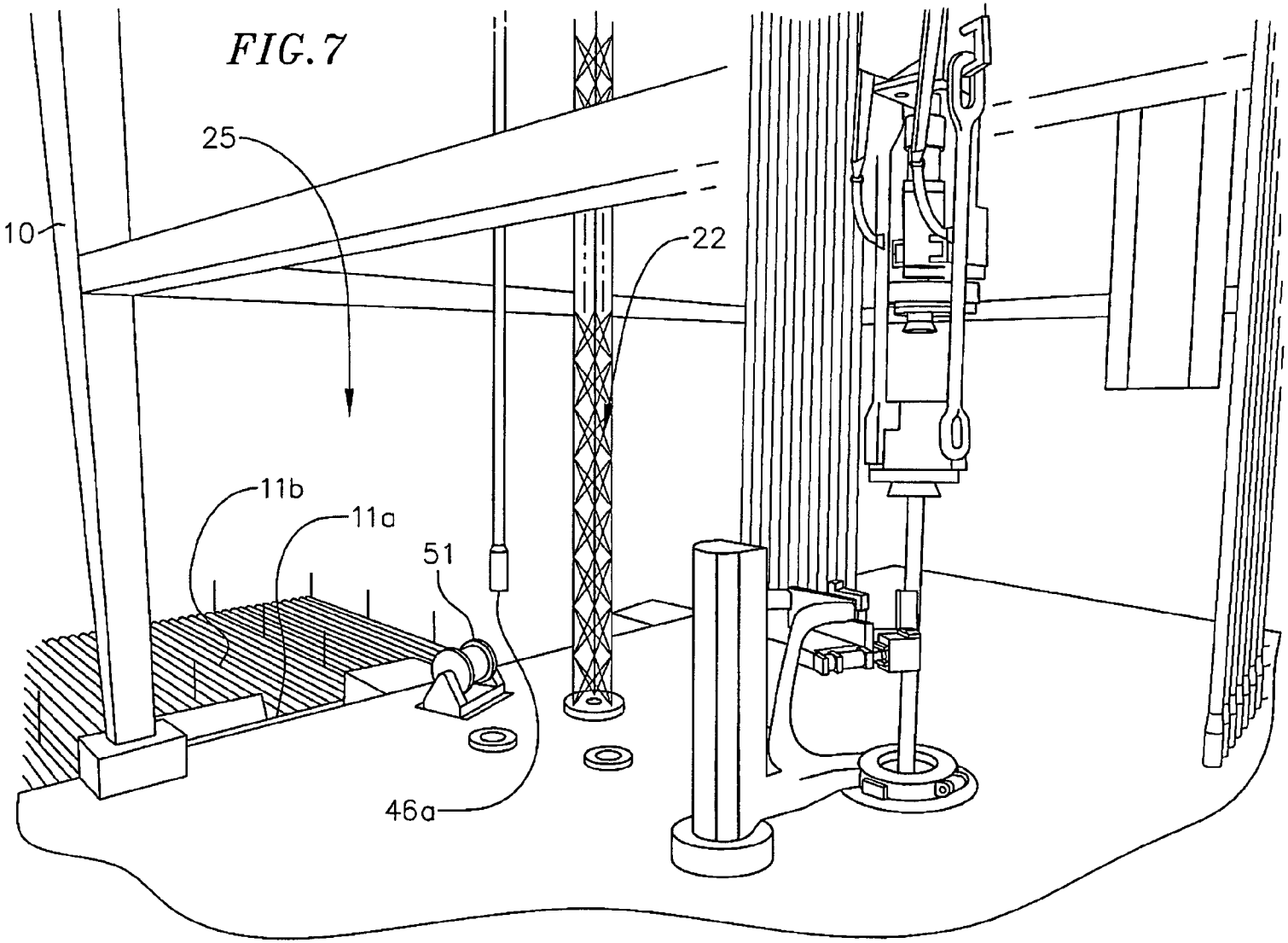
Figure 8:
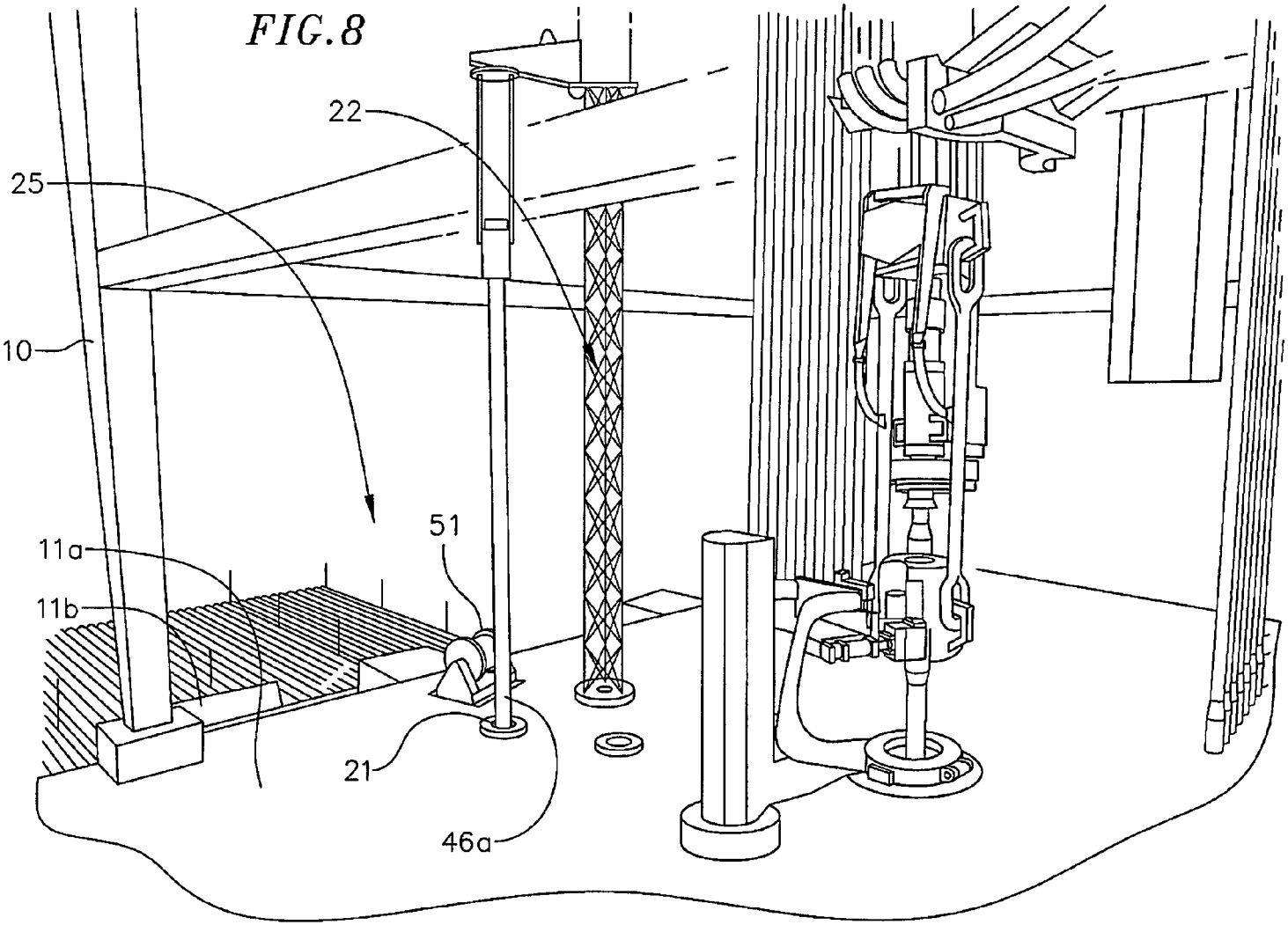

As shown in FIG. 4, the loading and preparation tube handling and transporting mechanism 22 is aligned such that the stroke and travel of the device allows for the movement of tubulars between the V-door and the preparation opening. It should be understood, however, that other suitable arrangements of the load and preparation pipehandling and transporting mechanism may be used. For example, as the figures also show, the gripping device may also be used to hoist and lift a tubular in a vertical direction. In another embodiment of the invention the load and preparation pipehandling and transporting mechanism may also provide a hoist mechanism designed to lift a tubular from off the drill floor 11, such as from a catwalk 11*a* via a tubular ramp 11*b* (such as that shown in FIG. 5), to within the range of the stroke and travel of the gripping device 24. As shown in FIG. 5, in one preferred embodiment the hoist is designed to extend outward off the drill platform 11 over the ramp 11*b* such that tubulars may be raised straight from an off-platform catwalk 11*a* to the outer reach of the transporting mechanism 22. Such a design prevents the normal swing associated with the loading and unloading of pipe from off the drill platform 11.

In this embodiment, the hoisting cable 24*a* used to hoist the gripping device 24 of the load and preparation mechanism 22 up and down the vertical shaft 35 runs through an assembly at the end of the fixed radius arm of the gripping device 24 such that when the gripping device is lowered to the bottom of the shaft 35 and reaches a stop position, the hoist cable and the gripper 24*b* at the end of the hoist cable 24*a* is capable of further movement down the ramp 11*b* onto the catwalk 11*a*. Once the gripper 24*b* is connected to a joint then, the hoist line 24*a* is retracted back to the main body of the load and preparation mechanism 22. In turn when the gripper 24*b* hits the underside o the main gripping device 24 the gripping device 24*b* is reconnected with the fixed radius arm and the entire gripping mechanism can be hoisted up the vertical truss 35 as in normal operation.

It should be understood that although preferred embodiments of the load and preparation pipehandling device are discussed above, that any suitable pipehandling device functionally able to manipulate and transport tubulars between a V-door, at least one preparation opening, and the second pipehandling device may be utilized in the current invention.

As shown in detail in FIG. 3, in one embodiment the storage pipehandling device 29 generally comprises an extendable gripping arm 31 having a gripper device 39 on its end mounted to a rotary platform 40 in the setback area within the derrick structure between the storage areas 26 and 27. The storage pipehandling device 29 provides generally for the movement of tubulars between the well center or stand building location to the setback position and back again. As shown, the gripping device 39 on the arm 31 may be extended a predefined distance out from the vertical shaft rotary platform 40. As the gripping device 39 may extend and swing around the axis of the storage pipehandling mechanism as the rotary platform 40 is rotated, the gripping device 39 may be moved within a circle 41 of defined outer radius which is indicated by a dot-and-dash line in FIG. 3. As shown in FIG. 4, the storage pipehandling and transporting mechanism 29 is aligned such that the stroke and travel of the device allows for the movement of tubulars between the storage areas 26 and 27, the preparation opening 21, and the drilling opening 18. It should be understood, however, that other suitable designs and arrangements of the storage pipehandling and transporting mechanism may be used such that the functionality to manipulate and transport tubulars between at least one preparation opening, a storage area, and a drilling opening are retained.

In addition, although one exemplary drill floor is depicted and discussed above, other configurations may be constructed to incorporate the combined load and preparation pipehandling device and the storage pipehandling device of the current invention. For example, a so-called rathole may also be defined in the drill floor for receiving a kelly in case it is desired to use a conventional rotary table drive in connection with the drilling rig. A second V-door through which drill string and well casing components may be supplied directly to the preparation opening may also be formed in the derrick in side-by-side relationship with the conventional V-door.

Ultimately it should be understood that the final arrangement and design of the tubular handling system of the current invention will depend on the design and location of the individual components of the drilling rig including: the V-door, the preparation opening(s), the drilling opening and associated drawworks, the storage area(s), and the tubular torquing tool.

The present invention is also directed to a method of operating a drilling rig using offline standbuilding system described above. One exemplary method of operation of the drilling rig described will now be explained in relation to FIGS. 6 to 21. FIGS. 6 to 13 illustrate how a drilling activities can be conducted in the off-line standbuilding system of the current invention while at the same time any number of pipe stands or assemblies may be assembled in a manner described below.

Figure 9:
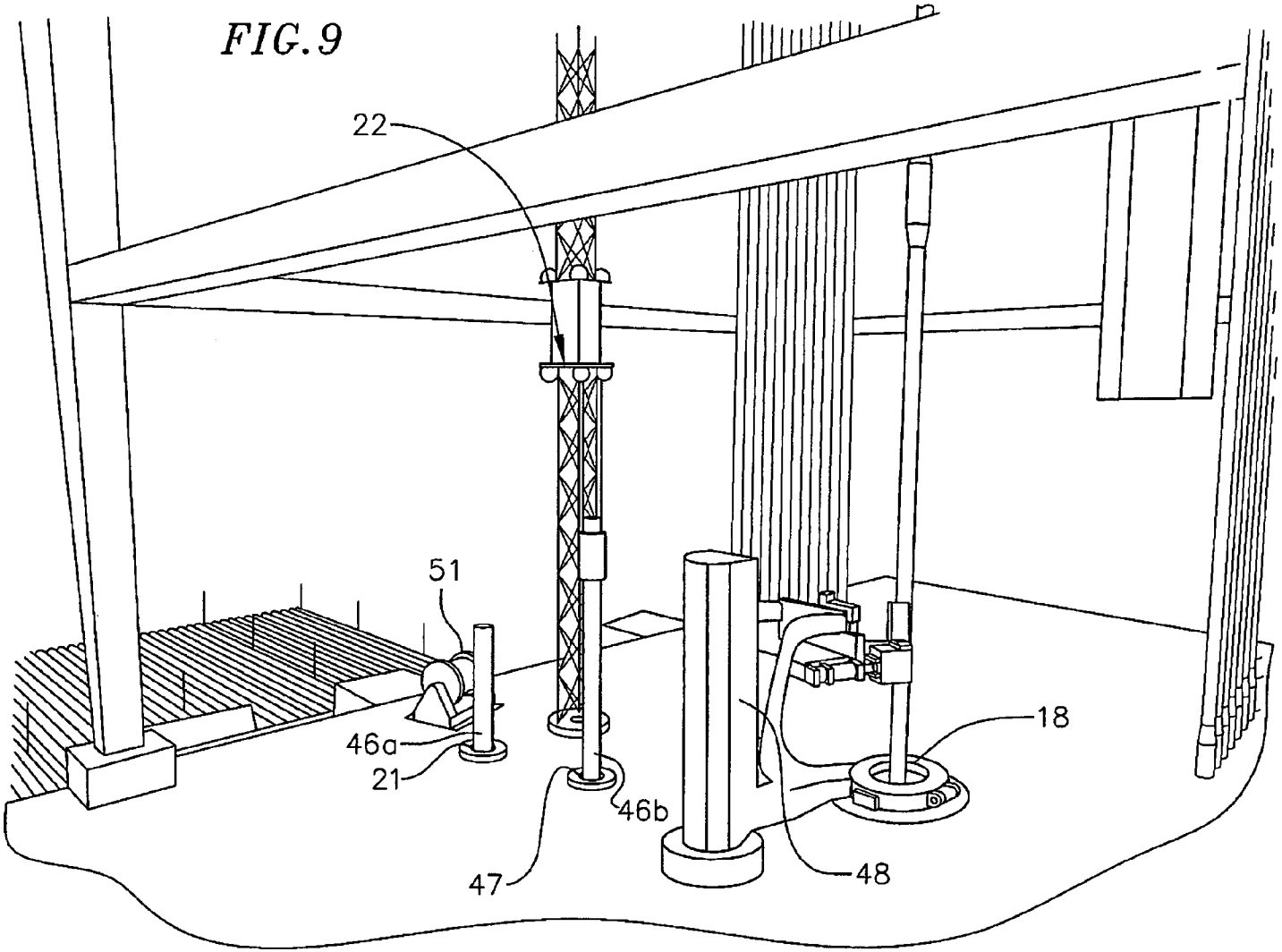

In general, according to one exemplary embodiment of the method of the invention, a standard triple stand may be assembled in the following manner:

A first single tubular body section, such as a drill tube section 46*a*, is loaded in from outside the derrick 10 from an off floor catwalk 11*a* up a tubular ramp 11*b* through the V-door 25 (FIG. 6), swiveled into position over the preparation opening (FIG. 7), and lowered into the preparation opening 21 (FIG. 8) by the hoist of the load and preparation pipehandling device 22. In this embodiment the hoist may take many forms. For example, the hoist could be an independent hoist device 51 which could be used only to bring the tubular through the V-door to the load and preparation pipehandling device. However, preferably the hoisting mechanism of the load and preparation pipehandling device itself is designed such that when lowered the gripper itself can be lowered onto the ramp and this gripper hoist can be used to first lift the single tubular body section from outside of the drilling area up a tubular ramp 11*b* through the V-door to the main body of the pipehandling device 22, as described above in FIG. 5. Subsequently, slips are set, the load and preparation pipehandling device 22 released, and a second single tubular body section 46*b* or tubular brought in through the V-door 25 in a similar manner. The load and preparation pipehandling device 22 either places this second single tubular 46*b* into a second adjacent preparation opening 47, as shown in FIG. 9, or suspends this second single tubular 46*b* above and adjacent to the first one 46a in the preparation opening, while the two are being assembled by either a conventional tubular torquing device, such as an iron roughneck 48 or by a tubular torquing device mounted on the load and preparation pipehandling device 22 (not shown). It should be understood that although the tubular torquing device 48 shown in FIG. 9 and discussed above is designed to rotate into and out of position that other suitable designs may be used, such as a tubular torquing device with a linear travel aligned along a path such that it may reach both preparation opening 21 and drill opening 18, or a combination device having both rotatable and linear travel.

In addition, although the preparation openings are described above as incorporating slips, it should be understood that any suitable mechanism for holding pipes within the preparation openings may be utilized. For example, the preparation openings may include a scabbard with either a fixed or adjustable bottom thereby eliminating the need for slips at the drill floor level.

Regardless of the actual design of the tubular torquing device, if a single preparation opening is used, the slips are released and the double tubular assembly 49 is lowered by the load and preparation pipehandling device 22 into the preparation opening 21 to a position where the upper end of the assembly is in normal working height above the drill floor 11. Slips are set, the load and preparation pipehandling device 22 is released, and a third single tubular 46*c* is brought in and the load and preparation pipehandling device 22 suspends this third single tubular 46*c* above and adjacent to the double assembly in the preparation opening 21 while the single tubular is being connected to the double assembly in the preparation opening 21 by means of the tubular torquing device 48.

Figure 10:
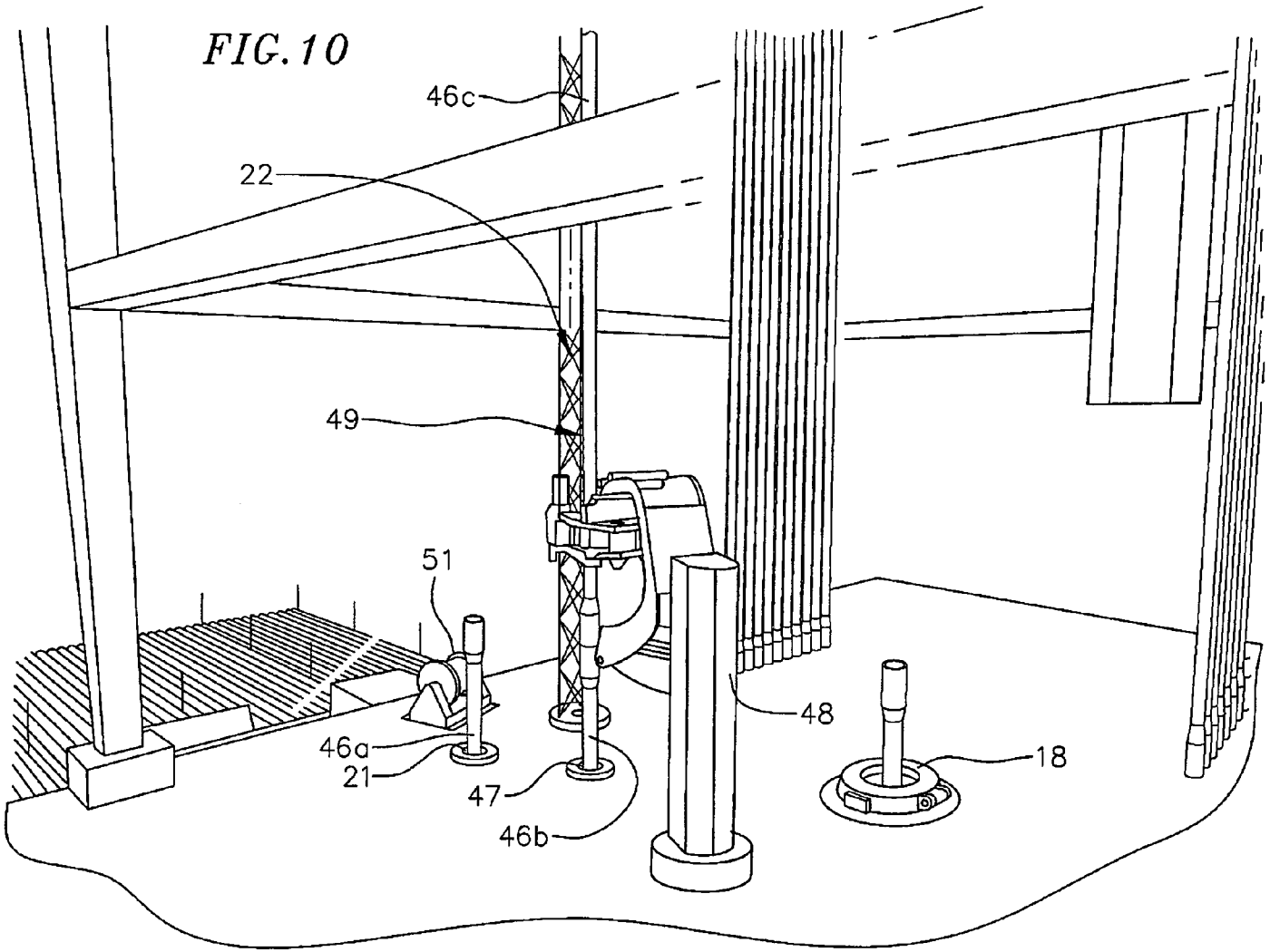
Figure 11:
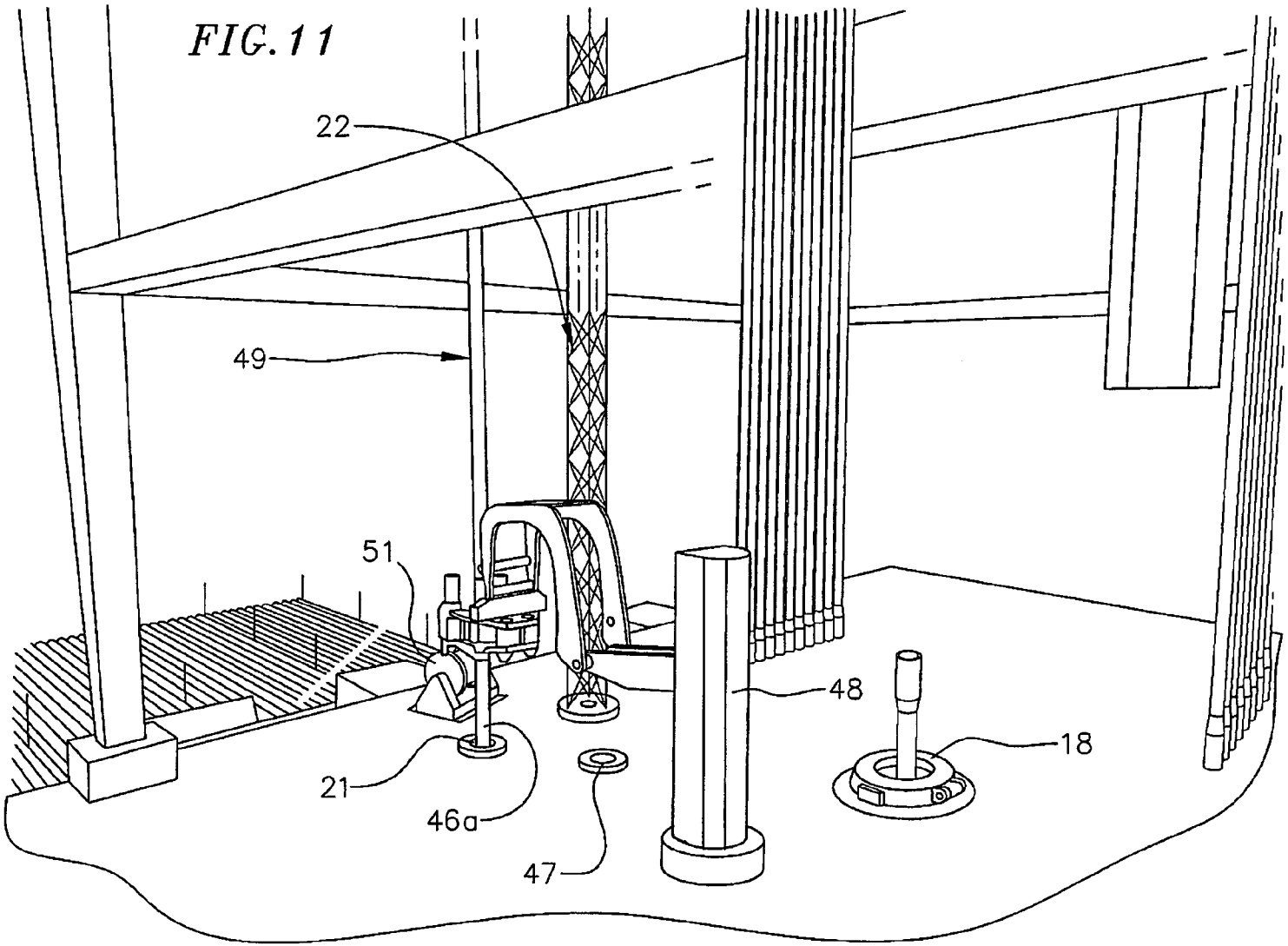
Figure 12:
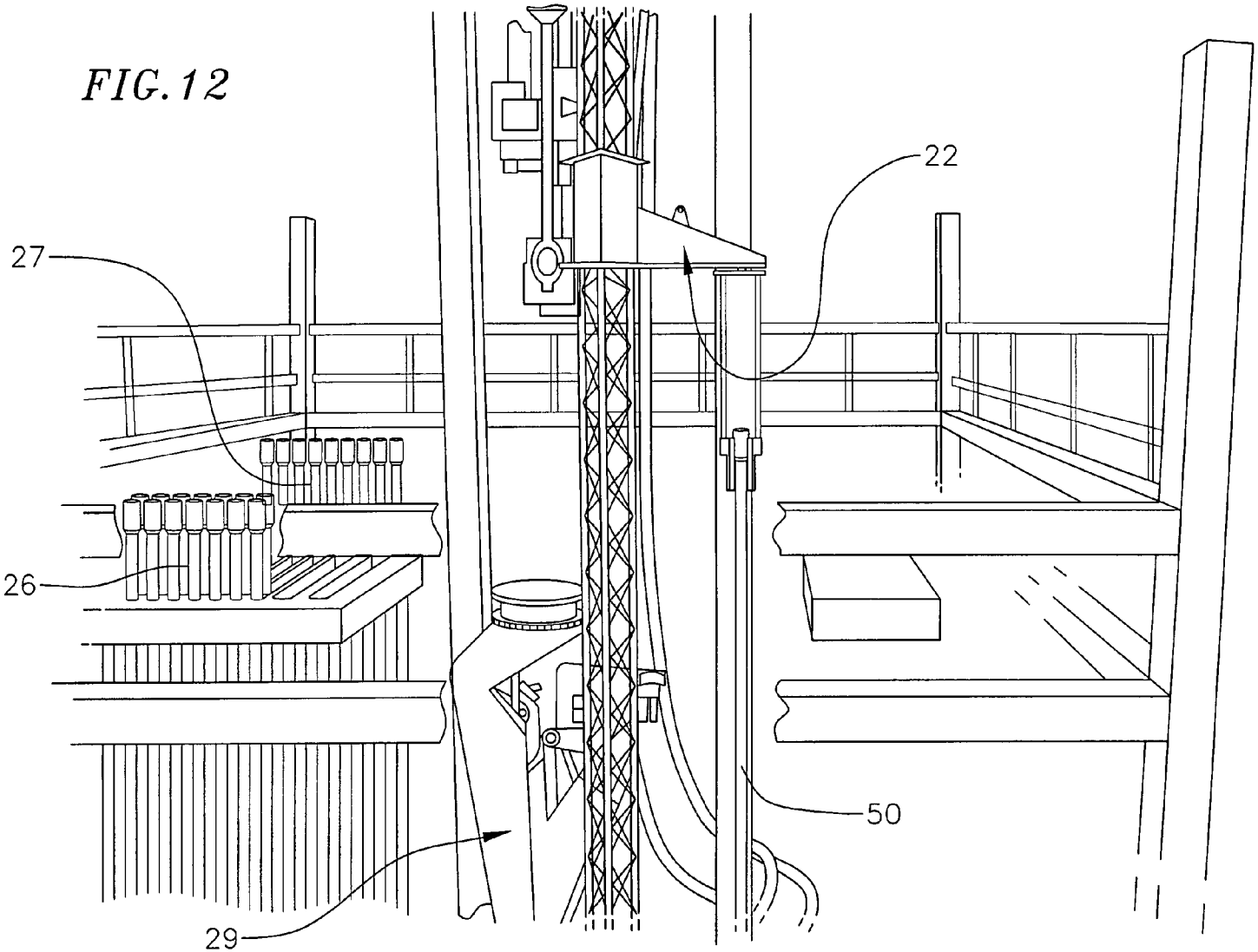
Figure 13:
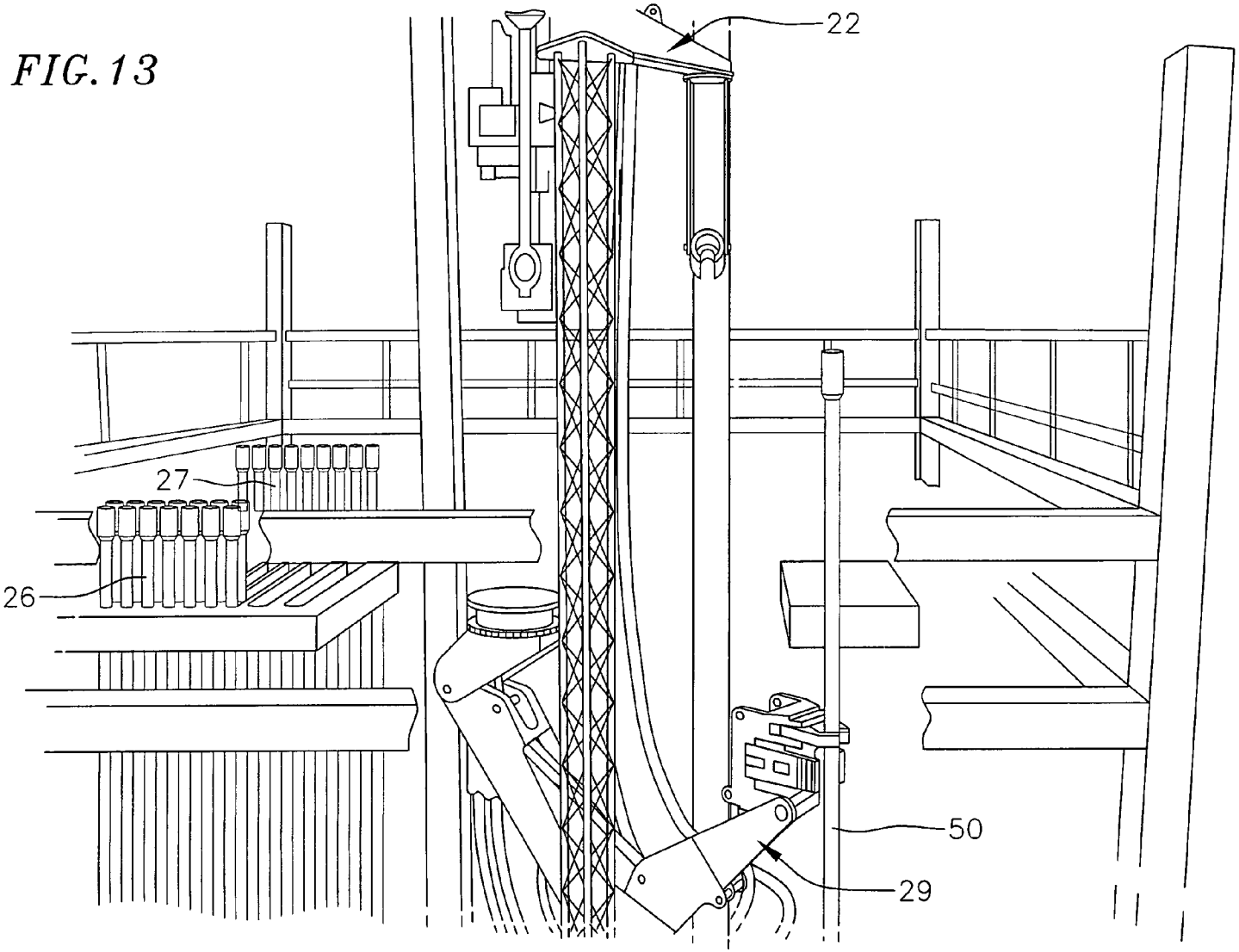
Figure 14:
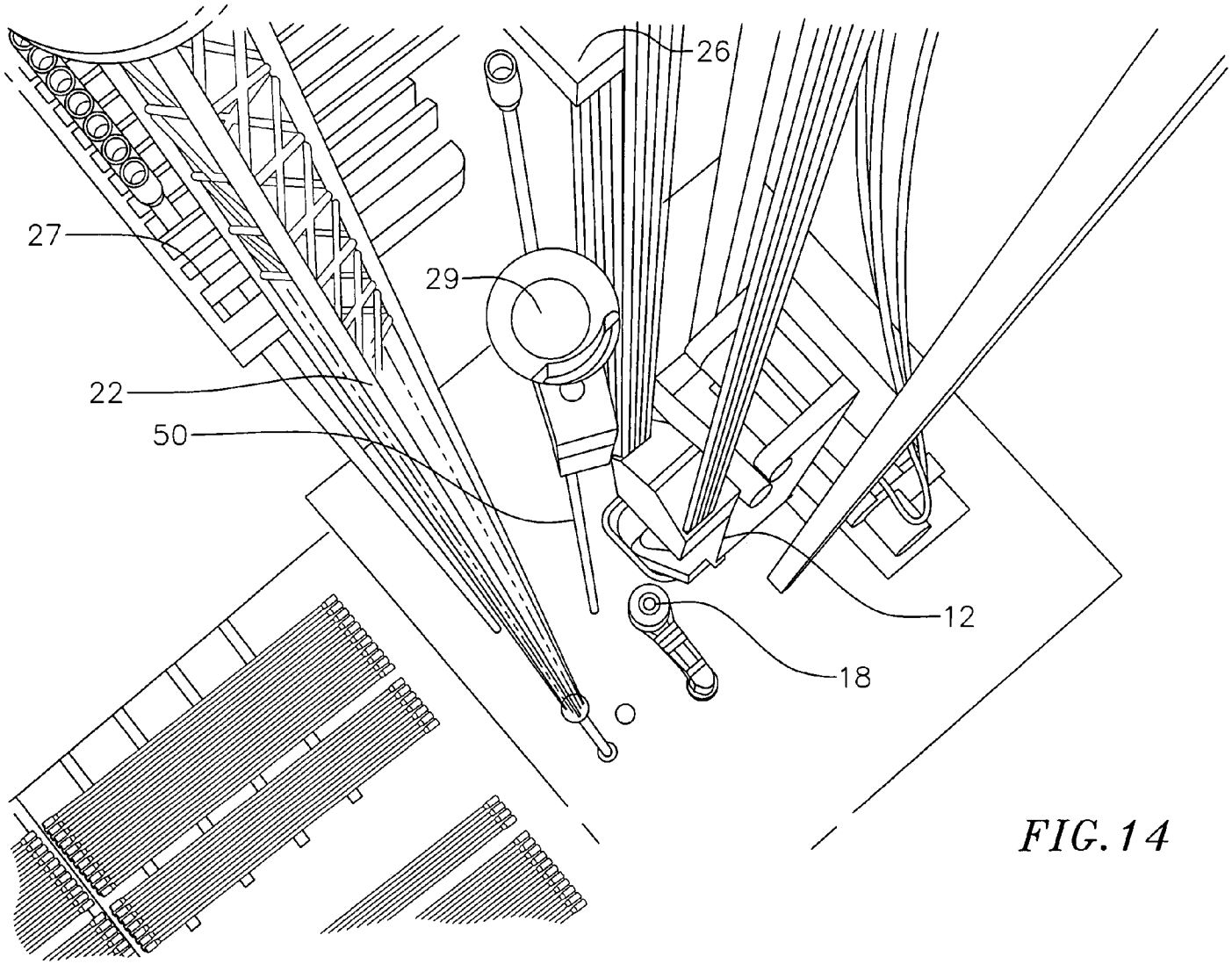
Figure 15:
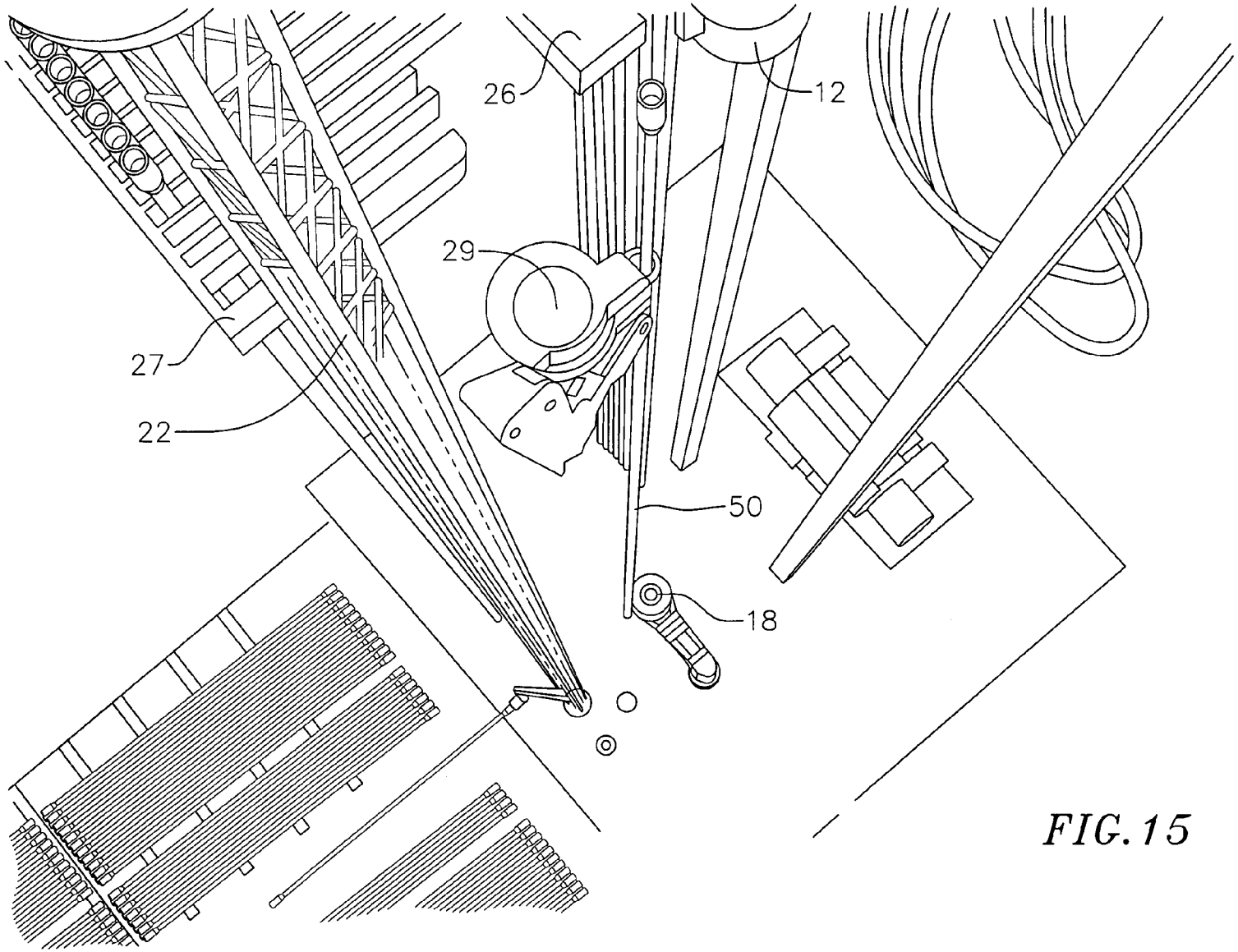

Alternatively, if two preparation openings are used, as shown in FIGS. 10 and 11, the third single tubular 46*c* is brought in and the load and preparation pipehandling device 22 suspends this third single tubular above and adjacent to the second single tubular 46*b* in the second preparation opening 47 the two single tubulars are then connected by means of the tubular torquing device 48 (FIG. 10). The load and preparation pipehandling device 22 then lifts the double assembly 49 out of the second preparation opening 47 and suspends this double assembly above and adjacent to the first single tubular 46*a* in the first preparation opening 21. The double assembly 49 and the single tubular 46*a* are then connected by means of the tubular torquing device 48 (FIG. 11).

Once the full triple assembly 50 is prepared, the slips on the preparation opening 21 are released and the completed triple stand is lifted out of the preparation opening 21 by the load and preparation pipehandling device 22, whereafter the completed stand is transferred to the storage pipehandling device 29 (FIG. 12), which may either move the stand to one of the storage areas 26 or 27 where the stand is stored (FIG. 13), or directly to the drilling opening 18 where the stand is transferred to the drill hoist 12. It should be understood that stands of well casing sections and other tubular sections such as drill collar sections may be assembled as described above, and that such stands may be disconnected into singles also by a reversed procedure at the preparation opening(s).

Bottomhole assemblies can also be put together in a similar way as that described above, but the number of parts in a 90' (app. 30 m) assembly may be different. For example, the process of making bottomhole assemblies will typically start with the drill bit, which is brought in and placed in a so-called bit breaker on top of the preparation opening followed by a tubular, so-called BHA part, which is brought in and suspended from the load an preparation pipehandling device, so that the lower end is contacting the drill bit (not shown). The two parts are connected by the spinning and torquing device 48 and then lifted out of the bit breaker. The bit breaker is removed and the interconnected two parts are lowered into the preparation opening and set in slips. From this point on, the stand is completed in the same way as other stands of drill collar sections, drill tube sections, etc. The stands prepared may be transported to one of the storage areas for later use.

Further, although the terms joints and tubulars are used generically throughout this discussion, it should be understood that the joints or tubular bodies used in the method and apparatus according to the invention may comprise drill tube singles, well casing singles, drill collars, stabilizers, centralizers, scratchers, drill bits, and other drill string or drill casing components as well as production tubing sections. By using the apparatus and method according to the invention, such tubular bodies may be assembled into tubular lengths, such as drill string and well casing stands (usually doubles or triples), bottomhole assemblies or bottomhole assembly parts, logging assemblies, etc.

Figure 16:
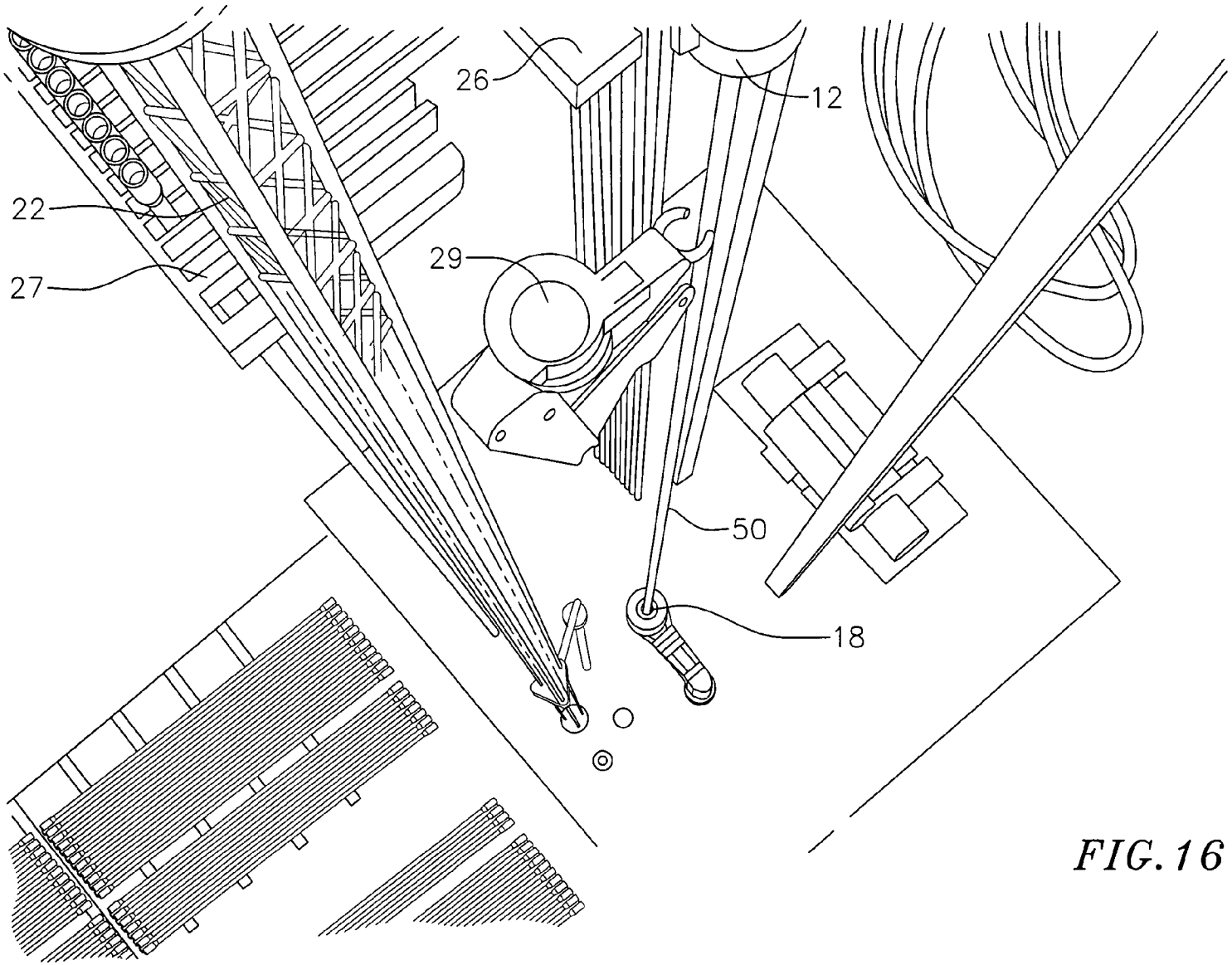

Although only the loading and preparation of a full stand are described above, it should be understood that simultaneous with this activity other drilling activities may be taking place, as shown in FIGS. 14 to 21. For example, at any point during the standbuilding procedure described above where the storage pipehandling device 29 is not in use, a made-up stand 50 or other downhole assembly may be transported from one of the storage areas 26 or 27 (FIG. 14) to the drilling hoist 12 (FIG. 15) in which the assembly may be suspended and thereafter lowered into the drill opening 18 (FIG. 16). As discussed, while the actual drilling operation is taking place, further drill string stands 50 may be prepared from single tubulars 46 or drill tube sections supplied through the V-door 25 as previously described. These prepared drill string stands 50 may be transported to the storage areas 26 and 27, or to the drilling opening 18.

Figure 17:
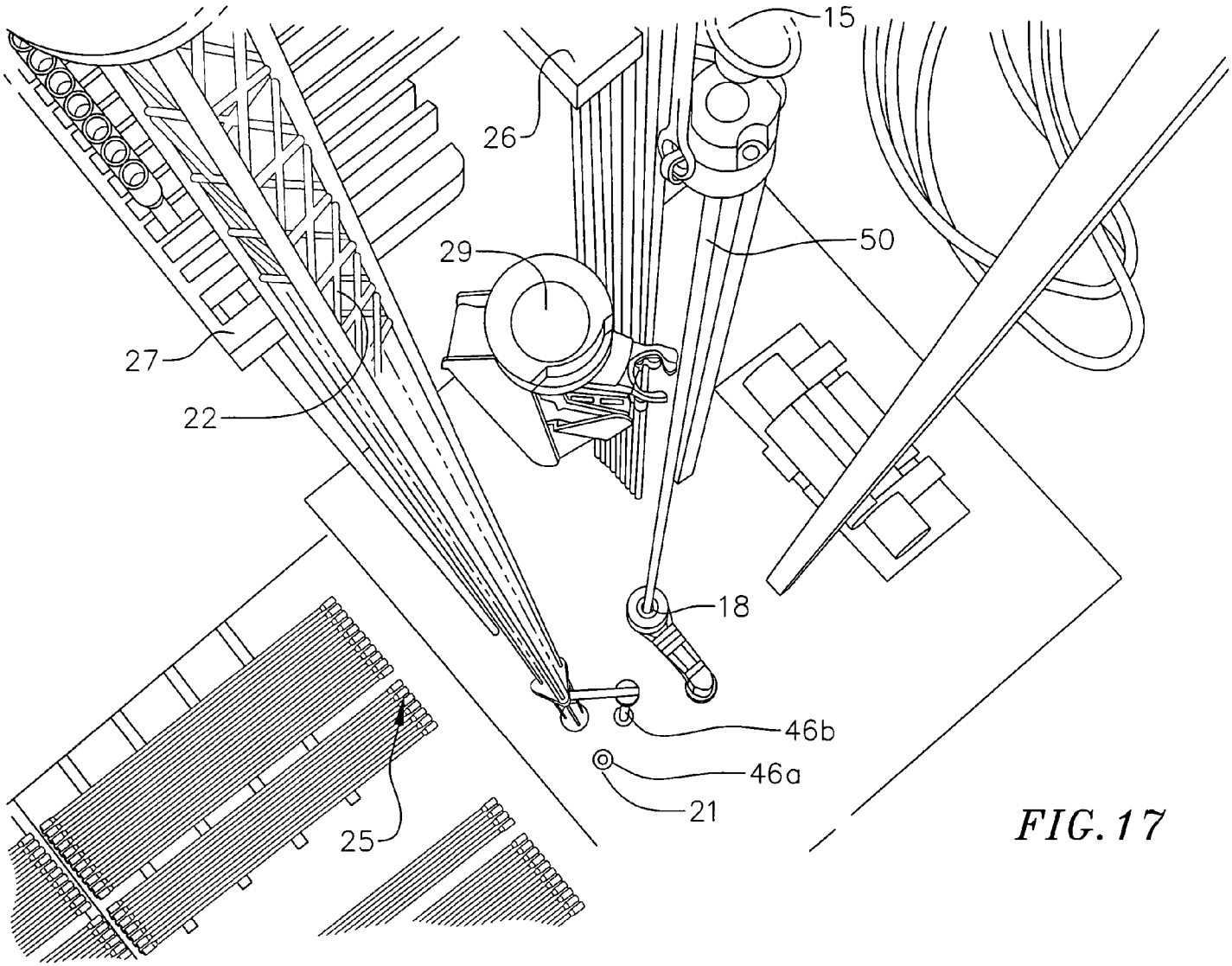

FIGS. 17 to 21 illustrate the overall operation of the system. In FIG. 17, the drilling operation has just been continued after addition of a drill string stand 50 to the upper end of the drill string, which means that the top drive unit 15 is in its upper position. At the same time, a further drill string stand 50 is being prepared at the preparation opening 21 in which a tube section 46*a* has been set by slips while a further tube section 46*b* has just been brought in through the V-door 25, such as up a tubular ramp 11*b* by the load and preparation pipehandling device 22.

Figure 18:
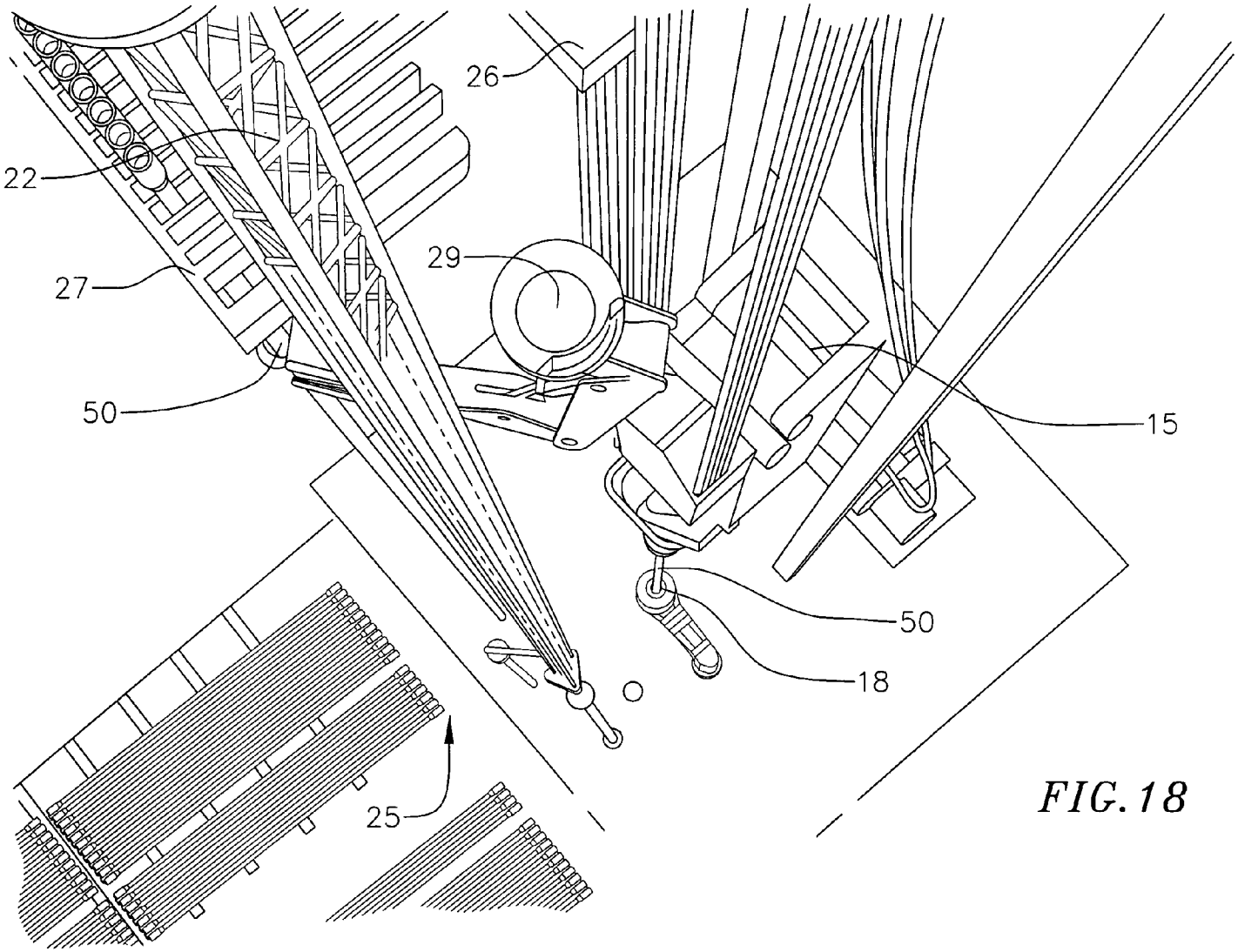

In FIG. 18 the drilling operation has proceeded and the top drive unit 15 has been moved a certain distance downwards. The preparation of a further drill string stand 50 has just been completed at the preparation opening 21, and the stand prepared has been gripped by the storage pipehandling device 29 which transports the drill string stand 50 to one of the storage areas 26 or 27.

Figure 19:
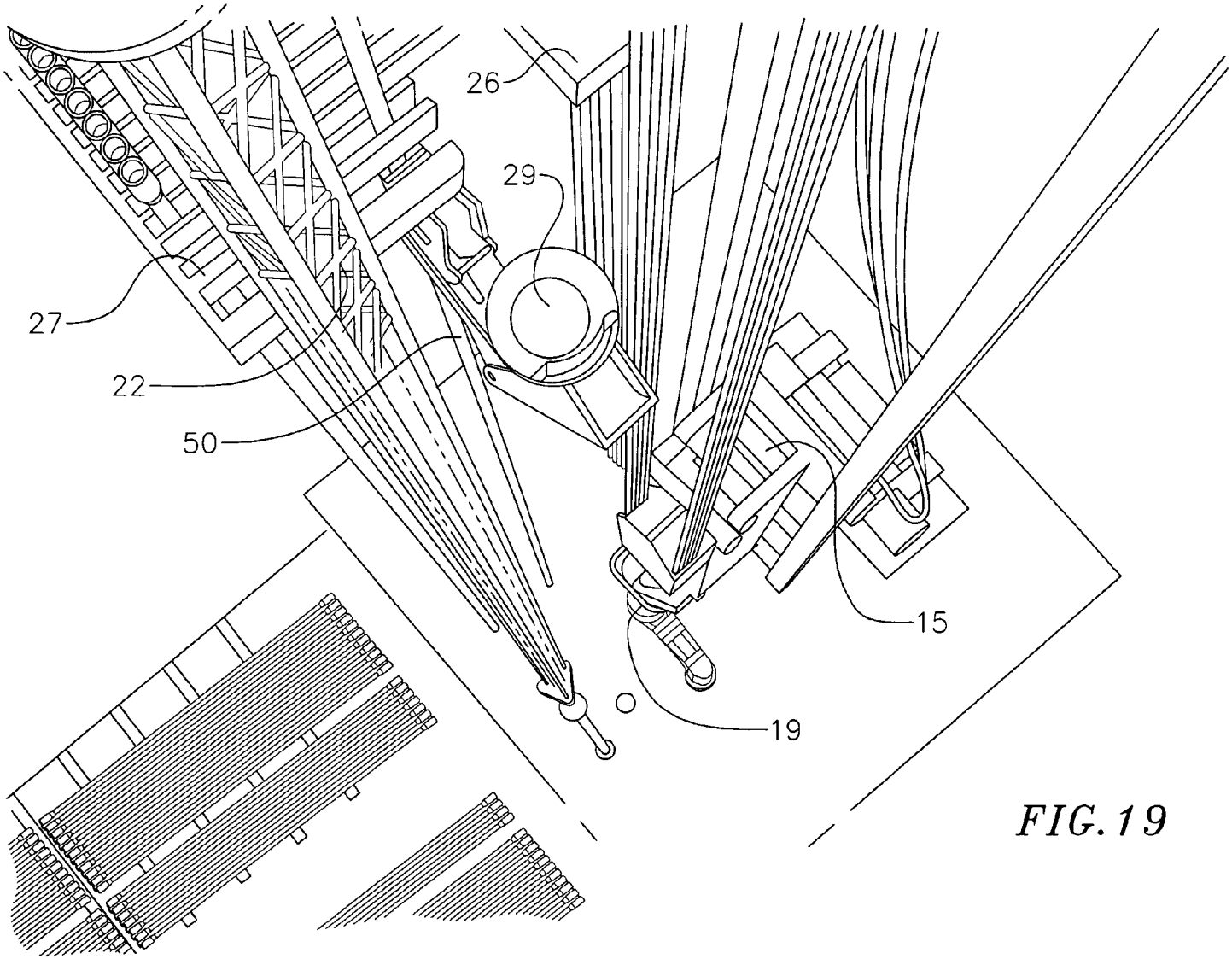
Figure 20:
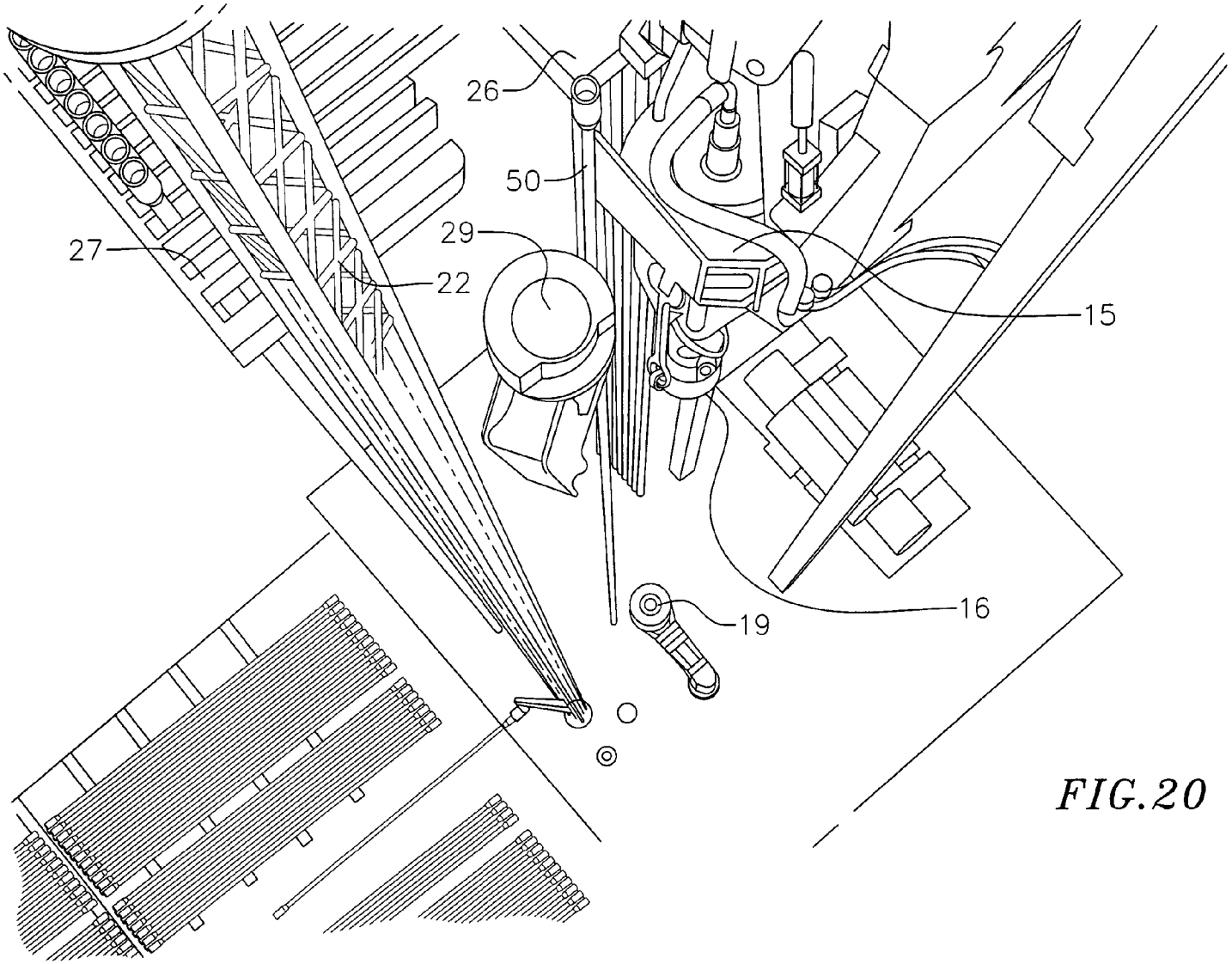
Figure 21:
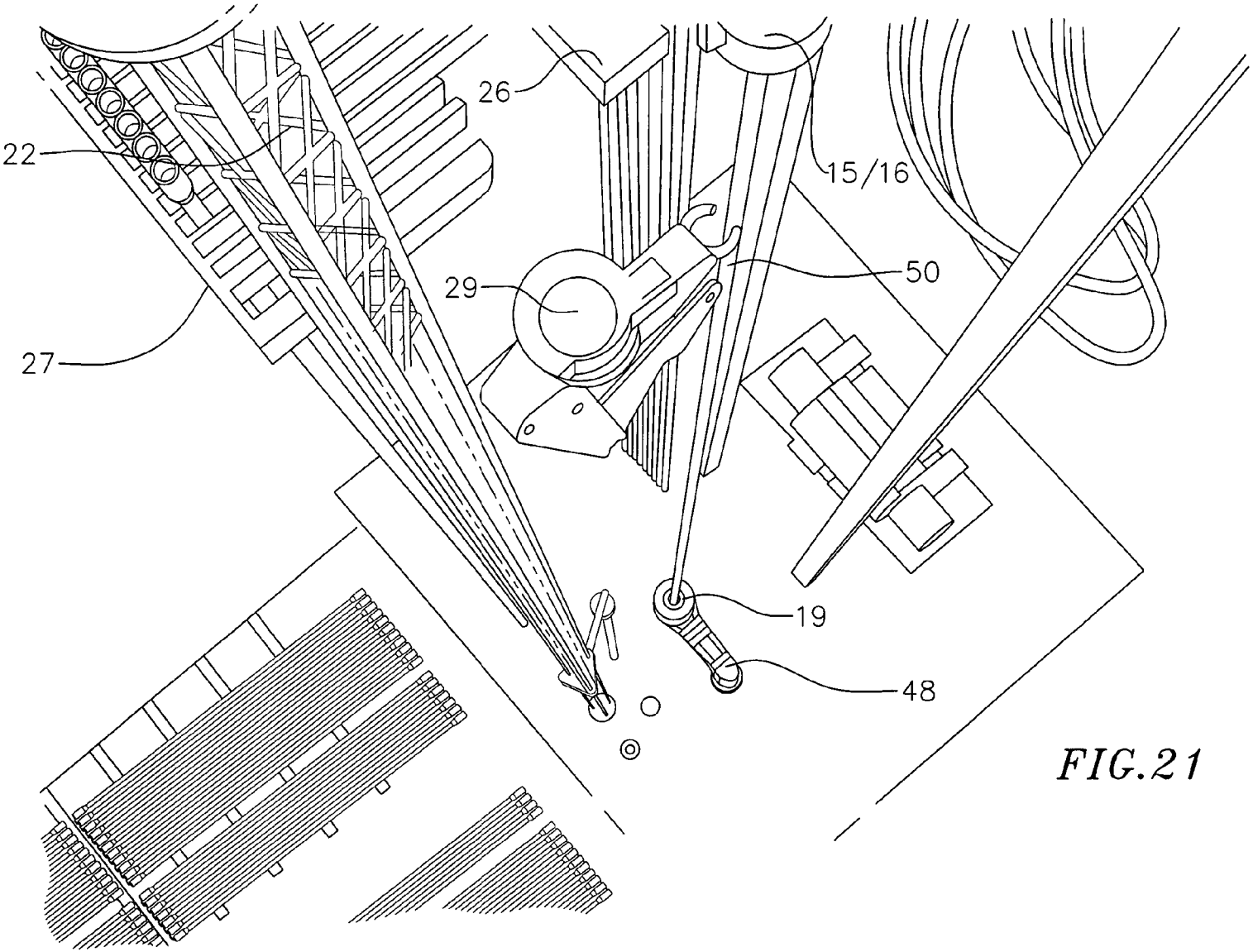

After a certain period of time the drill string 19 has penetrated such a distance into the underground that the top drive unit 15 reaches its lower position as shown in FIG. 19, and the drilling operation has to be stopped for the addition of a further drill string stand 50. Therefore, the top drive unit 15 is disconnected form the upper end of the drill string 19, and the carriage 16 supporting the top drive until 15 is moved to a retracted position shown in FIG. 20, whereby the top drive unit is moved to the left out of alignment with the drilling opening 18. (Note that while this description discuss a top drive block retraction system, this system is not required for the practice of the invention and any suitable top drive arrangement may be used.) While the top drive unit 15 is being moved upwards, a drill string stand 50 is gripped by the storage pipehandling device 29 at one of the storage areas 26 and 27 and moved to a position in which the stand 50 is positioned immediately above and is aligned with the drill string 19, FIG. 21. Thereafter, the stand 50 may be connected to the drill string 19 by means of the tubular torquing device 48. When the top drive unit 15 has reached its upper position the carriage 16 is returned to its normal, extended position, and the top drive unit may again be brought into driving engagement with the upper end of the newly mounted stand 50, whereafter the drilling operation may continue.

After a certain drilling period the bottomhole assembly has to be replaced, which means that the drill string 19 must be tripped out. The drill string is then disconnected into drill string stands 50 in a reverse process to that described above, and the drill stands are stored in the storage areas 26 and 27. As described above, the new bottomhole assembly may have been prepared beforehand at the preparation opening 21 in the manner previously described and may be ready in one of the storage areas 26 and 27.

It should be understood that well casing stands and other components, such as logging assemblies, may also be prepared at the preparation opening by procedures similar to those described above for bottomhole assembly parts and drill string stands. Thus, the method according to the invention renders it possible to reduce the idle time in operating a drill rig, whereby essential savings may be obtained.

Accordingly, although specific embodiments are disclosed herein, it is expected that persons skilled in the art can and will design alternative offline standbuilding systems and methods that are within the scope of the following claims either literally or under the Doctrine of Equivalents.

What is claimed is:

1. A system for handling tubular body sections at a drilling site comprising:

a drill platform having a derrick extending upwards therefrom, the drill platform and derrick defining a drill area;

a first hoist connected to an upper part of the derrick for passing a tubular body through a drilling opening defined in the drill platform;

at least one storage area being arranged within the drill area for storing a plurality of tubular lengths, each of the tubular lengths comprising at least two releasably interconnected tubular body sections;

at least one preparation opening extending through the drill platform at a location spaced from the drilling opening and from the at least one storage area;

a torquing tool for rotatably interconnecting tubular bodies at the at least one preparation opening to form tubular lengths:

a first pipehandling device for transporting tubular bodies and tubular lengths from outside the drill area to the at least one preparation opening and a tubular exchange point; and a second pipehandling device for transporting tubular lengths between the at least one storage area, the tubular exchange point, and the first hoist;

where the first and second pipehandling devices are disposed to allow the direct exchange of tubular lengths therebetween at the tubular exchange point.

2. The system according to claim 1, wherein the first pipehandling device comprises an axially rotatable vertical strut having at least one gripping device for gripping tubular bodies and tubular lengths attached thereto.

3. The system according to claim 2, wherein the at least one gripping device is further designed to hoist tubular bodies and tubular lengths vertically.

4. The system according to claim 2, wherein the first pipehandling device further comprises a hoist capable of lowering the gripping device outside the drill area to on outside tubular storage area.

5. The system according to claim 2, wherein said-gripping device comprises at least two vertically aligned gripping devices arranged on the strut.

6. The system according to claim 2, wherein said gripping device is extendable radially outward from the axial center of the first pipehandling device.

7. The system according to claim 1, wherein the second pipehandling device comprises a gripping arm positioned adjacent to the at least one storage area, and wherein the gripping arm is rotatable about a vertical axis and laterally extendable.

8. The system according to claim 1, wherein the torquing tool is an iron roughneck.

9. The system according to claim 1, wherein the torquing tool is rotatable about a vertical axis and laterally extendable such that the torquing tool is capable of engaging tubular bodies or tubular lengths at both the at least one preparation opening and the drilling opening.

10. The system according to claim 1, wherein the at least one storage area is positioned between the drilling opening and the preparation opening.

11. The system according to claim 1, comprising at least two separate storage areas wherein the second pipehandling device is positioned between the at lest two storage areas.

12. The system according to claim 1, further comprising a tubular ramp for transporting tubular bodies from a storage area outside the drill area to drill platform, wherein the first pipehandling device extends outward over the tubular ramp.

13. The system according to claim 1, wherein the derrick defines a first access opening through which the first pipehandling device may grip the tubular bodies from outside the drill area.

14. A method for manipulating tubular body sections at a drilling site comprising:

providing a tubular handling system comprising:

a drill platform having a derrick extending upwards therefrom, the drill platform and derrick defining a drill area, a first hoist connected to an upper part of the derrick for passing a tubular body through a drilling opening defined in the drill platform.

at least one storage area being arranged within the drill area for storing a plurality of tubular lengths, each of the tubular lengths comprising at least two releasably interconnected tubular bodies, at least one preparation opening extending through the drill platform at a location spaced from the drilling opening and from the at least one storage area, a torquing tool for rotatably interconnecting tubular bodies at the at least one preparation opening to form tubular lengths, a first pipehandling device for transporting tubular bodies and tubular lengths from outside the drill area to the at least one preparation opening and a tubular exchange point, and a second pipehandling device for transporting tubular lengths between the at least one storage area, the tubular exchange point, and the first hoist;

where the first and second pipehandling devices are disposed to allow the direct exchange of tubular lengths therebetween at the tubular exchange point;

transporting a plurality of tubular bodies from outside the drill area to the at least one preparation opening in a substantially vertical position by means of the first pipehandling device:

forming a tubular length by releasably interconnecting the plurality of tubular bodies with the torquing tool, while one of the tubular bodies extends through the preparation opening and another is suspended by means of the first pipehandling device, and withdrawing the prepared tubular length from the preparation opening by means of said first pipehandling device;

exchanging the prepared tubular length between the first and second pipehandling devices in a substantially vertical position at the tubular exchange point:

transporting the prepared tubular length to the at least one storage area in a substantially vertical position by means of said second pipehandling device;

transporting tubular lengths from the storage area to the drilling opening in a substantially vertical position by means of said second pipehandling device, and releasably connecting said tubular lengths to the upper end of a drill stem suspended within the drilling opening with the torquing tool to form a completed drill stand, and successively lowering the drill stand through the drilling opening by means of said first hoist.

15. The method according to claim 14, wherein said tubular length includes three tubular bodies, said tubular length being formed by arranging a first tubular body in the preparation opening with the first pipehandling device so that a substantial part thereof extends below the drill platform, and including the steps of:

holding a second tubular body above the upper end of the first body with the first pipehandling device and connecting the two tubular bodies with the torquing device; and thereafter holding a third tubular body above the upper end of the interconnected first and second bodies with the first pipehandling device and connecting the third tubular body to the interconnected first and second bodies with the torquing device.

16. The method to claim 15, including the step of lowering the interconnected first and second bodies so as to place the first body and a substantial part of the second body below the drill platform, whereafter the third body is connected to the upper end of the second body extending above said drill platform.

17. The method according to claim 14, wherein said tubular length includes three tubular bodies, said tubular length being formed by a method including the steps of:

arranging a first tubular body section in a first preparation opening with the first pipehandling device so that a substantial part thereof extends below the drill floor or platform, arranging a second tubular body in a second preparation opening adjacent to the first preparation opening with the first pipehandling device so that a substantial part thereof extends below the drill platform, holding a third tubular body above the upper end of the second body with the first pipehandling device and connecting the two tubular bodies with the torquing device; and thereafter holding the interconnected second and third bodies above the upper end of the first body with the first pipehandling device and connecting the interconnected second and third bodies to the first body with the torquing device.

18. The method according to claim 14, further including the steps of:

disconnecting tubular lengths from the upper end of the drill string at the drilling opening with the torquing tool, while successively withdrawing the drill string upwards through the drilling opening, and transporting the disconnected tubular lengths from the drilling opening to the storage area in a substantially vertical position by means of the second pipehandling device.

19. The method according to claim 14, further including the steps of:

transporting tubular lengths from the storage means to the first pipehandling device at the tubular exchange point in a substantially vertical position by means of said second pipehandling means, lowering each tubular length through the at least one preparation opening by means of the first pipehandling mean, retaining the tubular length in at the least one preparation opening, successively releasing the interconnection between adjacent tubular bodies above the upper surface of the drill platform with the torquing tool, and transporting the released tubular bodies from the preparation opening by means of the first pipehandling device.

20. The method according to claim 14, wherein the tubular body is a drill string.

21. The method according to claim 14, wherein the tubular lengths comprise bottomhole assembly parts.

22. The method according to claim 14, wherein the tubular body is a well casing.

23. The method according to claim 14, wherein the tubular body is a production tubing.

24. The method according to claim 14, wherein the axial dimension of each of said tubular lengths corresponds substantially to the inner free height of the derrick.

25. The method according to claim 14, wherein the first pipehandling device comprises an axially rotatable vertical strut having at least one gripping device for gripping tubular bodies and tubular lengths attached thereto.

26. The method according to claim 25, wherein the at least one gripping device is further designed to hoist tubular bodies and tubular lengths vertically.

27. The method according to claim 25, wherein the first pipehandling device further comprises a hoist capable of lowering the gripping device outside the drill area to an outside tubular storage area.

28. The method according to claim 25, wherein said gripping device comprises at least two vertically aligned gripping devices arranged on the strut.

29. The method according to claim 25, wherein said gripping device is extendable radially outward from the axial center of the first pipehandling device.

30. The method according to claim 14, wherein the second pipehandling device comprises a gripping arm positioned adjacent to the at least one storage area, and wherein the gripping arm is rotatable about a vertical axis and laterally extendable.

31. The method according to claim 14, wherein the torquing tool is an iron roughneck.

32. The method according to claim 14, wherein the torquing tool is rotatable about a vertical axis and laterally extendable such that the torquing tool is capable of engaging tubular bodies or tubular lengths at both the at least one preparation opening and the drilling opening.

33. The method according to claim 14, wherein the at least one storage area is positioned between the drilling opening and the preparation opening.

34. The method according to claim 14, comprising at least two separate storage areas wherein the second pipehandling device is positioned between the at last two storage areas.

35. The method according to claim 14, further comprising a third pipehandling device for transporting tubular bodies from a storage area outside the drill area to said first pipehandling device.

36. The method according to claim 14, further comprising a tubular ramp for transporting tubular bodies from a storage area outside the drill area to drill platform, wherein the first pipehandling device extends outward over the tubular ramp.

37. The method according to claim 14, wherein the derrick defines a first access opening through which the first pipehandling device may grip the tubular bodies from outside the drill area.

* * * * *